US009370950B2

(12) United States Patent
Tanaka

(10) Patent No.: US 9,370,950 B2
(45) Date of Patent: Jun. 21, 2016

(54) PRINTER

(71) Applicant: Brother Kogyo Kabushiki Kaisha, Nagoya-shi, Aichi-ken (JP)

(72) Inventor: Mitsugi Tanaka, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/636,899

(22) Filed: Mar. 3, 2015

(65) Prior Publication Data

US 2015/0251466 A1 Sep. 10, 2015

(30) Foreign Application Priority Data

Mar. 4, 2014 (JP) ..... 2014-042203

(51) Int. Cl.

| | |
|---|---|
| ***B41J 15/02*** | (2006.01) |
| ***B41J 15/16*** | (2006.01) |
| ***B41J 15/20*** | (2006.01) |
| ***B41J 15/22*** | (2006.01) |
| ***B65H 18/02*** | (2006.01) |
| ***B65H 18/08*** | (2006.01) |
| ***B65H 18/10*** | (2006.01) |
| ***B65H 41/00*** | (2006.01) |
| ***B41J 3/407*** | (2006.01) |

(52) U.S. Cl.

CPC ..... *B41J 15/22* (2013.01); *B41J 3/4075* (2013.01); *B41J 15/02* (2013.01); *B41J 15/16* (2013.01); *B41J 15/20* (2013.01); *B65H 18/021* (2013.01); *B65H 18/023* (2013.01); *B65H 18/085* (2013.01); *B65H 18/103* (2013.01); *B65H 18/106* (2013.01); *B65H 41/00* (2013.01); *B65H 2301/414328* (2013.01)

(58) Field of Classification Search

CPC .. B65H 18/021; B65H 18/025; B65H 18/103; B65H 18/12; B41J 2/32; B41J 15/16; B41J 15/22

See application file for complete search history.

(56) References Cited

U.S. PATENT DOCUMENTS

| | | | | | |
|---|---|---|---|---|---|
| 4,788,558 | A | * | 11/1988 | Caldwell et al. | 347/215 |
| 5,245,354 | A | * | 9/1993 | Ono et al. | 347/217 |
| 8,845,219 | B2 | | 9/2014 | Tanaka | |
| 2013/0291790 | A1 | * | 11/2013 | Tanaka | 118/40 |

FOREIGN PATENT DOCUMENTS

| | | | |
|---|---|---|---|
| JP | 2003-305930 | A | 10/2003 |
| JP | 2013-233664 | A | 11/2013 |

* cited by examiner

*Primary Examiner* — Kristal Feggins
*Assistant Examiner* — Kendrick Liu
(74) *Attorney, Agent, or Firm* — Banner & Witcoff, Ltd.

(57) ABSTRACT

A printer includes a printing head, a take-up driving device, a take-up amount detecting portion, a constant torque control device, and a switching control portion. The take-up driving device drives a take-up portion for taking up at least a part of layers of the recording medium fed by a feeder on an outer circumference part and forming a roll. The take-up amount detecting portion detects a take-up amount by the take-up portion. The constant torque control device performs constant torque control that sets a driving torque of the take-up driving device to a constant value corresponding to an input command value. The switching control portion switches the command value in stages in accordance with an increase in the take-up amount detected by the take-up amount detecting portion associated with an advancement of the take-up by the take-up portion.

4 Claims, 14 Drawing Sheets

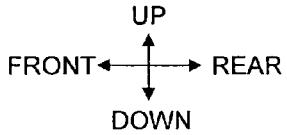
FIG. 12A
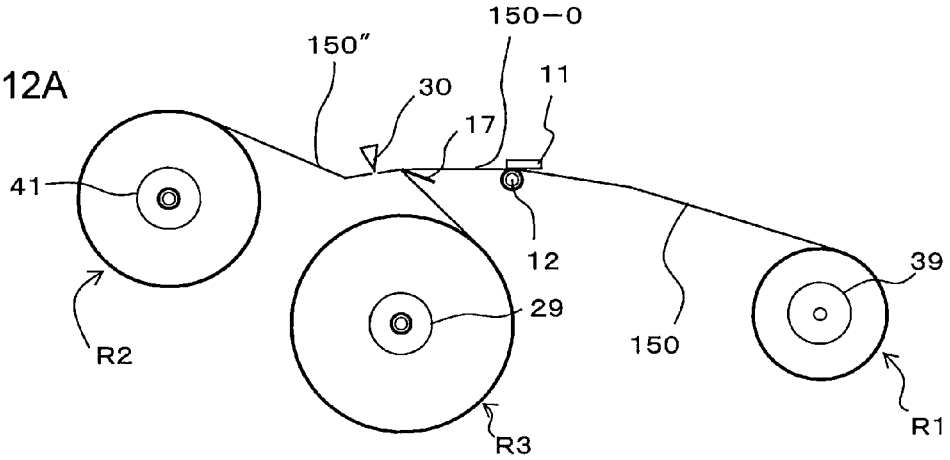
FIG. 12B
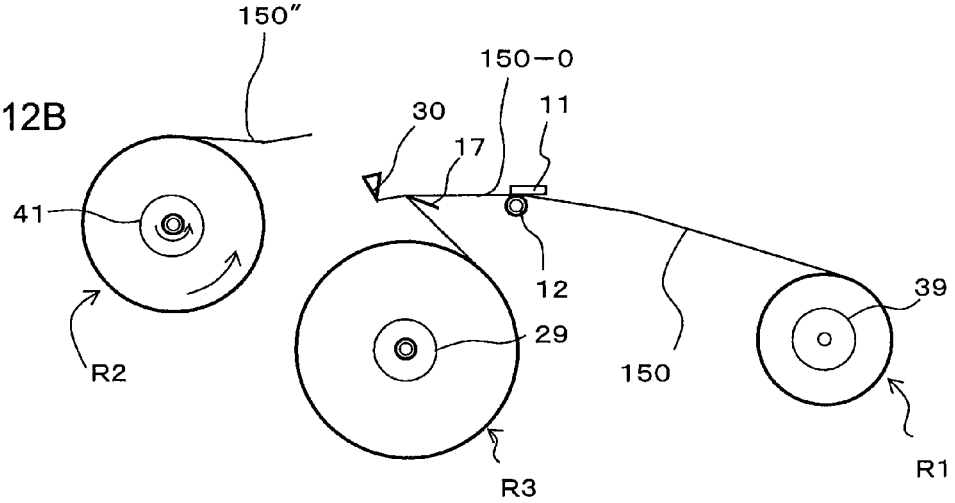

PRINTER

CROSS-REFERENCE TO RELATED APPLICATION

The present application claims priority from Japanese Patent Application No. 2014-042203, which was filed on Mar. 4, 2014, the disclosure of which is incorporated herein by reference in its entirety.

BACKGROUND

1. Field

The present disclosure relates to a printer that performs printing on a recording medium.

2. Description of the Related Art

There are known printers that form desired print on a print-receiving tape. According to the printer of this prior art, the print-receiving tape (print-receiving adhesive tape) is fed by a feeding roller, and desired print is formed on the fed print-receiving tape by a printing head. At this time, a separation material layer peeled from the print-receiving tape is sequentially taken up on the outer circumference part of take-up portion (a winding core member) driven by driving device (a take-up motor), forming a roll.

In the prior art described above, when the take-up portion performs take-up as described above, the separation material layer is layered in the radial direction as time passes, increasing the outer diameter of the roll. Accordingly, since a relatively large torque is required for smooth take-up, constant torque control that constantly maintains a driving torque of the driving device is preferably performed. In such a case, provision of a constant torque control portion comprising a function that maintains the driving torque of the driving device at a value (constant value) corresponding to an input command value may be considered.

However, with the advancement of the take-up described above, the roll outer diameter resulting from the separation material layer around the take-up portion gradually increases. Accordingly, to reliably perform smooth take-up at the maximum outer diameter, a command value that imparts a large driving torque corresponding to the maximum outer diameter needs to be input to the constant torque control portion.

Nevertheless, immediately after the start and during the initial period of take-up of the separation material layer by the take-up portion, the roll outer diameter is small and so the required driving torque is also small. Accordingly, when a command value corresponding to the maximum outer diameter is input to the constant torque control portion as described above immediately after the start and during the initial period of take-up, the driving device wastefully generates a large torque (that actually should not be required). In the prior art described above, such a viewpoint was not taken into particular consideration.

SUMMARY

It is therefore an object of the present disclosure to provide a printer capable of suppressing wasteful generation of a large torque that is actually not required and executing efficient torque control.

In order to achieve the above-described object, according to the aspect of the present application, there is provided a printer comprising a feeder configured to feed a long recording medium, a printing head configured to perform printing on the recording medium fed by the feeder, a take-up driving device configured to drive a take-up portion for sequentially taking up at least a part of layers of the recording medium fed by the feeder on an outer circumference part and forming a roll, a take-up amount detecting portion configured to detect a take-up amount by the take-up portion, a constant torque control device configured to perform constant torque control that sets a driving torque of the take-up driving device to a constant value corresponding to an input command value, and a switching control portion configured to switch the command value output to the constant torque control device in stages in accordance with an increase in the take-up amount detected by the take-up amount detecting portion associated with an advancement of the take-up by the take-up portion.

According to the printer of the present disclosure, the recording medium is fed by a feeder, and desired print is formed on the fed recording medium tape by a printing head. At this time, according to the present disclosure, the recording medium or a part of layers thereof (hereinafter suitably simply referred to as "medium layers") is sequentially taken up on the outer circumference part of the take-up portion driven by the take-up driving device, forming a roll.

When the take-up portion performs take-up as described above, the medium layers are layered in the radial direction as time passes, increasing the outer diameter of the roll. Accordingly, since a relatively large torque is required for smooth take-up, in the present disclosure, constant torque control with respect to the take-up driving device is performed. That is, the constant torque control portion performs control that constantly maintains the driving torque of the take-up driving device.

Then, in the present disclosure, take-up amount detecting portion and switching control portion are provided. The take-up amount detecting portion detects the take-up amount of the above described medium layers by the take-up portion. Then, the switching control portion switches the command value output to the constant torque control portion in accordance with the take-up amount detected by the take-up amount detecting portion. Specifically, from the time the detected take-up amount is relatively small (immediately after the start or during the initial period of take-up described above), the command value output to the constant torque control portion is switched in stages as the detected take-up amount increases.

With this arrangement, it is possible to control the take-up driving device so as to generate a driving torque of a size that corresponds to the increase in the outer diameter of the medium layers around the take-up portion and is appropriate for the take-up of medium layers having that outer diameter. As a result, it is possible to suppress the wastefulness of generating a large torque that is actually not required as described above, and execute efficient torque control.

BRIEF DESCRIPTION OF THE DRAWINGS

FIG. 12A is an explanatory view showing the tape feeding, cutting, take-up behavior, and the like during printing execution.

FIG. 12B is an explanatory view showing the tape feeding, cutting, take-up behavior, and the like during printing execution.

DETAILED DESCRIPTION OF THE PREFERRED EMBODIMENTS

Figure 1:
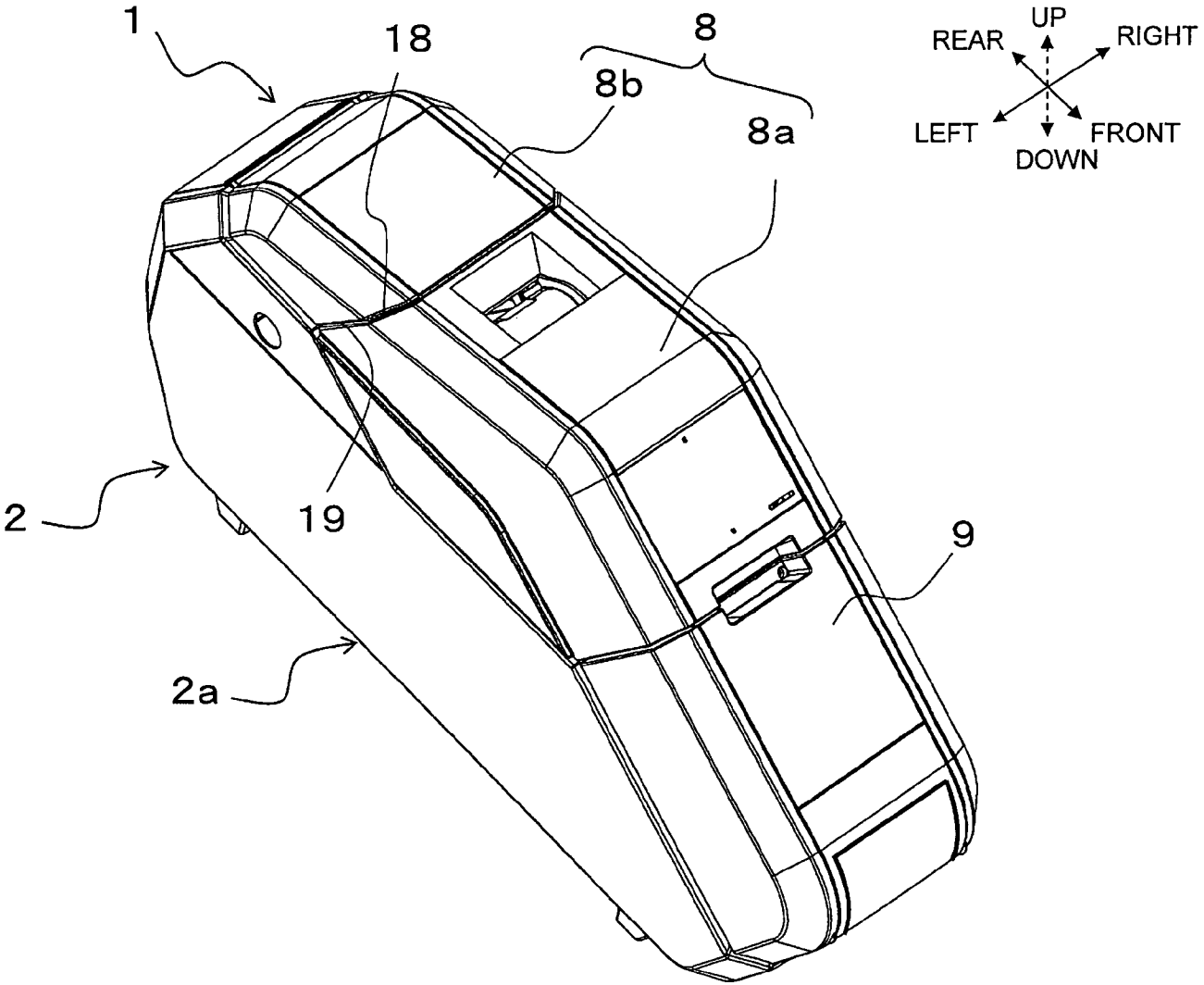
FIG. 1 is a perspective view showing the outer appearance of the tape printer related to an embodiment of the present disclosure.

The following describes one embodiment of the present disclosure with reference to accompanying drawings. Note that, in a case where "Front," "Rear," "Left," "Right," "Up," and "Down" are denoted in the drawings, the terms "Frontward (Front)," "Rearward (Rear)," "Leftward (Left)," "Rightward (Right)," "Upward (Up)," and "Downward (Down)" in the explanations of the description refer to the denoted directions.

General Configuration of Tape Printer

First, the general configuration of the tape printer related to this embodiment will be described with reference to FIGS. 1-4.

Housing

In FIGS. 1-4, a tape printer 1 in this embodiment comprises a housing 2 that constitutes the apparatus outer contour. The housing 2 comprises a housing main body 2*a*, a rearward-side opening/closing part 8, and a frontward-side opening/closing cover 9.

The housing main body 2*a* comprises a first storage part 3 disposed on the rearward side, and a second storage part 5 and a third storage part 4 disposed on the frontward side.

The rearward-side opening/closing part 8 is connected to an upper area of the rearward side of the housing main body 2*a* in an openable and closeable manner. This rearward-side opening/closing part 8 is capable of opening and closing the area above the first storage part 3 by pivoting. The rearward-side opening/closing part 8 comprises a first opening/closing cover 8*a* and a second opening/closing cover 8*b*.

The first opening/closing cover 8*a* is capable of opening and closing the area above the frontward side of the first storage part 3 by pivoting around a predetermined pivot axis K1 disposed in the upper area of the rearward side of the housing main body 2*a*. Specifically, the first opening/closing cover 8*a* is capable of pivoting from a closed position (the states in FIGS. 1 and 2) in which it covers the area above the frontward side of the first storage part 3, to an open position (the states in FIGS. 3 and 4) in which it exposes the area above the frontward side of the first storage part 3.

Figure 2:
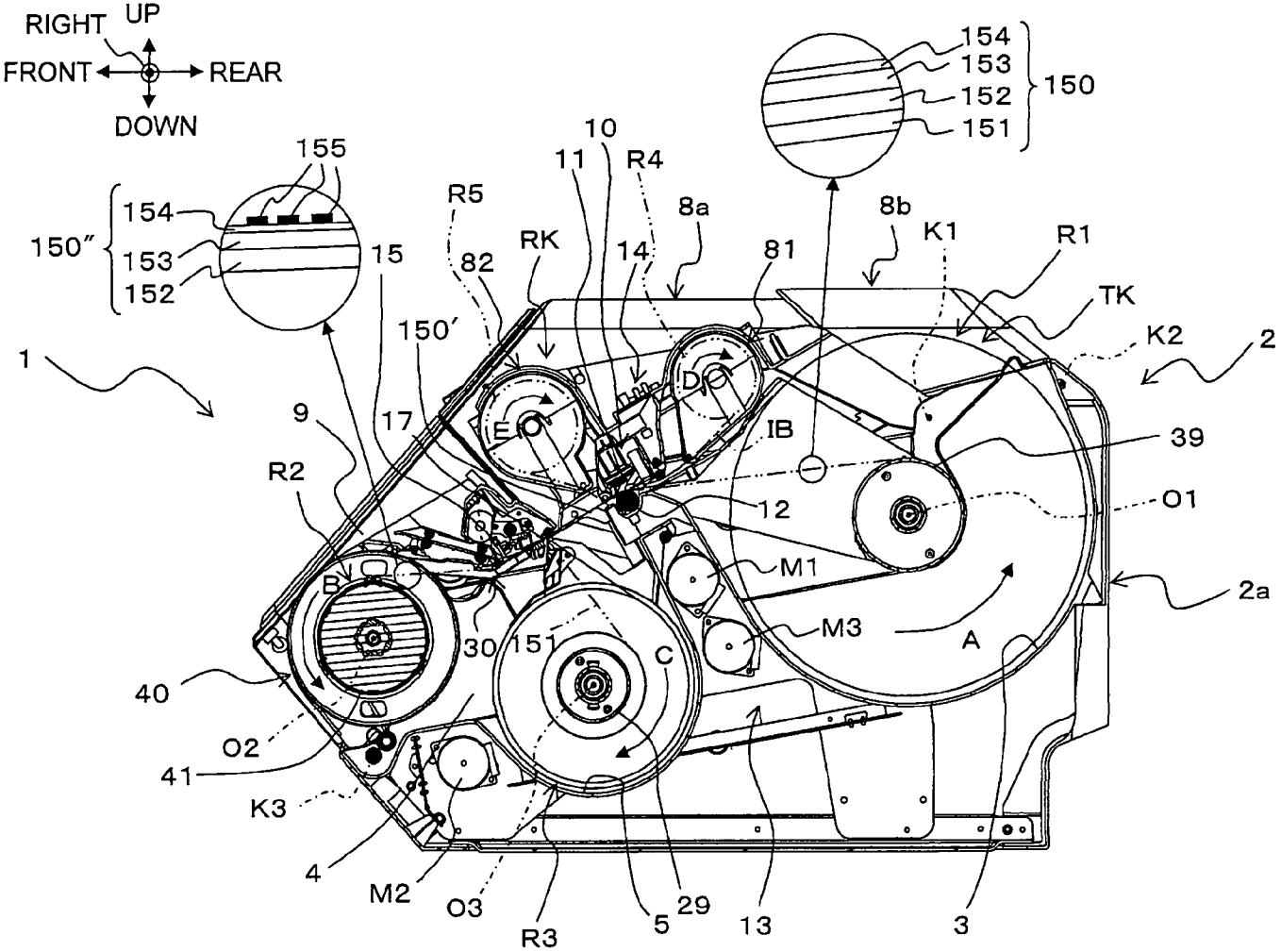
FIG. 2 is a side cross-sectional view showing the internal structure of the tape printer.
Figure 3:
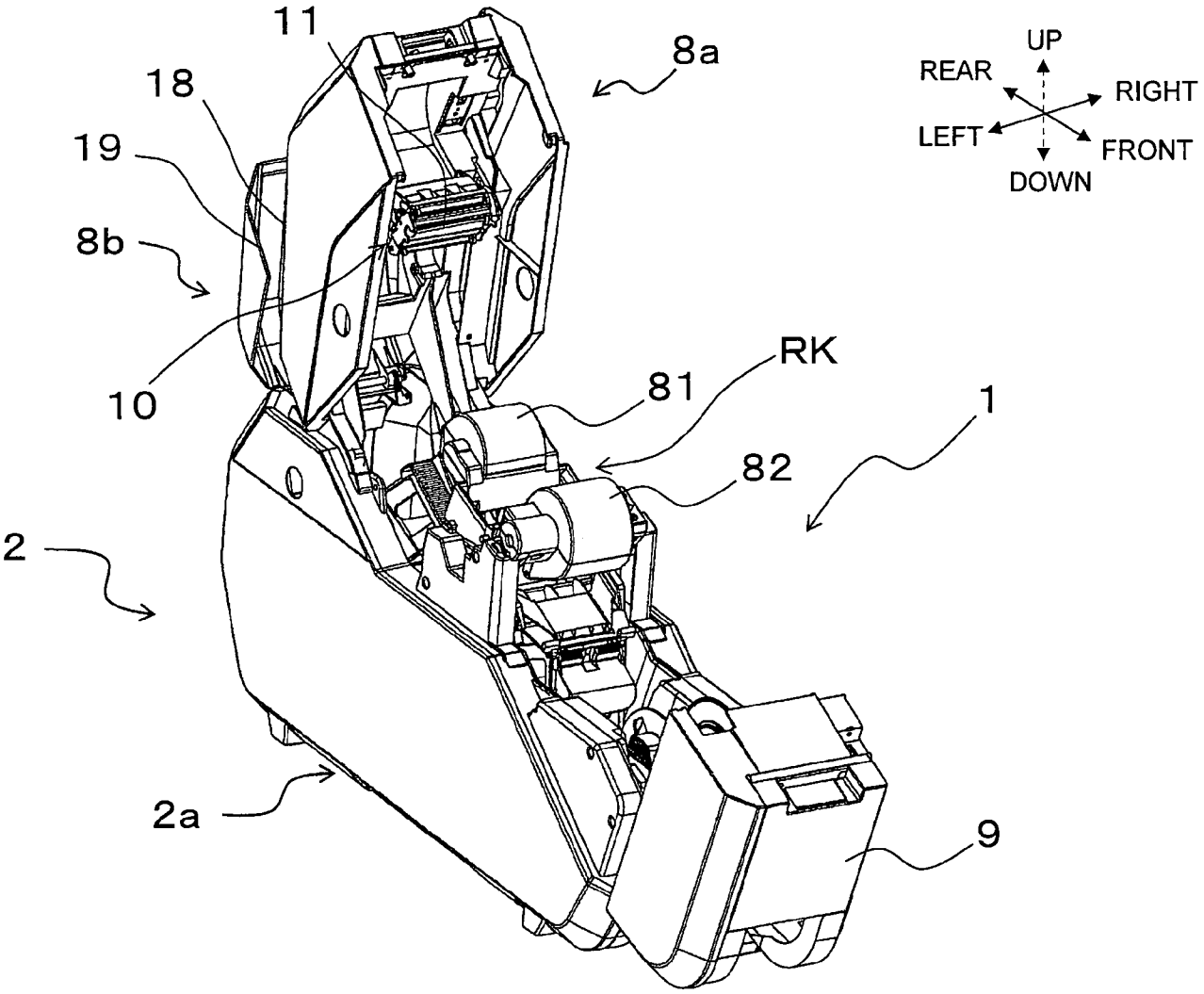
FIG. 3 is a perspective view showing the outer appearance of the tape printer with the first, second, and frontward-side opening/closing covers open.

A head holding body 10 is disposed in the interior of the first opening/closing cover 8*a* (refer to FIG. 3 as well). Then, the first opening/closing cover 8*a* pivots around the above described pivot axis K1, making it possible to move a printing head 11 included in the head holding body 10 relatively closer to or farther away from a feeding roller 12 disposed in the housing main body 2*a*. That is, the printing head 11 moves close to the feeding roller 12 in the above described closed position (the states in FIGS. 1 and 2) of the first opening/closing cover 8*a*, and moves away from the feeding roller 12 in the above described open position (the states in FIGS. 3 and 4) of the first opening/closing cover 8*a*.

The second opening/closing cover 8*b* is disposed further on the rearward side than the above described first opening/closing cover 8*a*, and is capable of opening and closing the area above the rearward side of the first storage part 3 separately from the opening and closing of the above described first opening/closing cover 8*a* by pivoting around a predetermined pivot axis K2 disposed on the upper end of the rearward side of the housing main body 2*a*. Specifically, the second opening/closing cover 8*b* is capable of pivoting from a closed position (the states in FIGS. 1 and 2) in which it covers the area above the rearward side of the first storage part 3, to an open position (the states in FIGS. 3 and 4) in which it exposes the area above the rearward side of the first storage part 3.

Then, the first opening/closing cover 8*a* and the second opening/closing cover 8*b* are configured so that, when each is closed, an outer circumference part 18 of the first opening/closing cover 8*a* and an edge part 19 of the second opening/closing cover 8*b* substantially contact each other and cover almost the entire area above the first storage part 3.

The frontward-side opening/closing cover 9 is connected to the upper area of the frontward side of the housing main body 2*a* in an openable and closeable manner. The frontward-side opening/closing cover 9 is capable of opening and closing the area above the third storage part 4 by pivoting around a predetermined pivot axis K3 disposed on the upper end of the frontward side of the housing main body 2*a*. Specifically, the frontward-side opening/closing cover 9 is capable of pivoting from a closed position (the states in FIGS. 1 and 2) in which it covers the area above the third storage part 4, to an open position (the states in FIGS. 3 and 4) in which it exposes the area above the third storage part 4.

Note that a housing board BD is disposed in the interior of the housing main body 2*a* (refer to FIG. 4 and FIG. 6 described later).

Print-Receiving Tape Roll and Surrounding Area Thereof

At this time, as shown in FIG. 2, a tape cartridge TK is detachably mounted in a first predetermined position 13 below the frontward-side opening/closing cover 9 (when closed) of the housing main body 2*a*. This tape cartridge TK comprises a first roll R1 wound around and formed on an axis O1.

Figure 5:
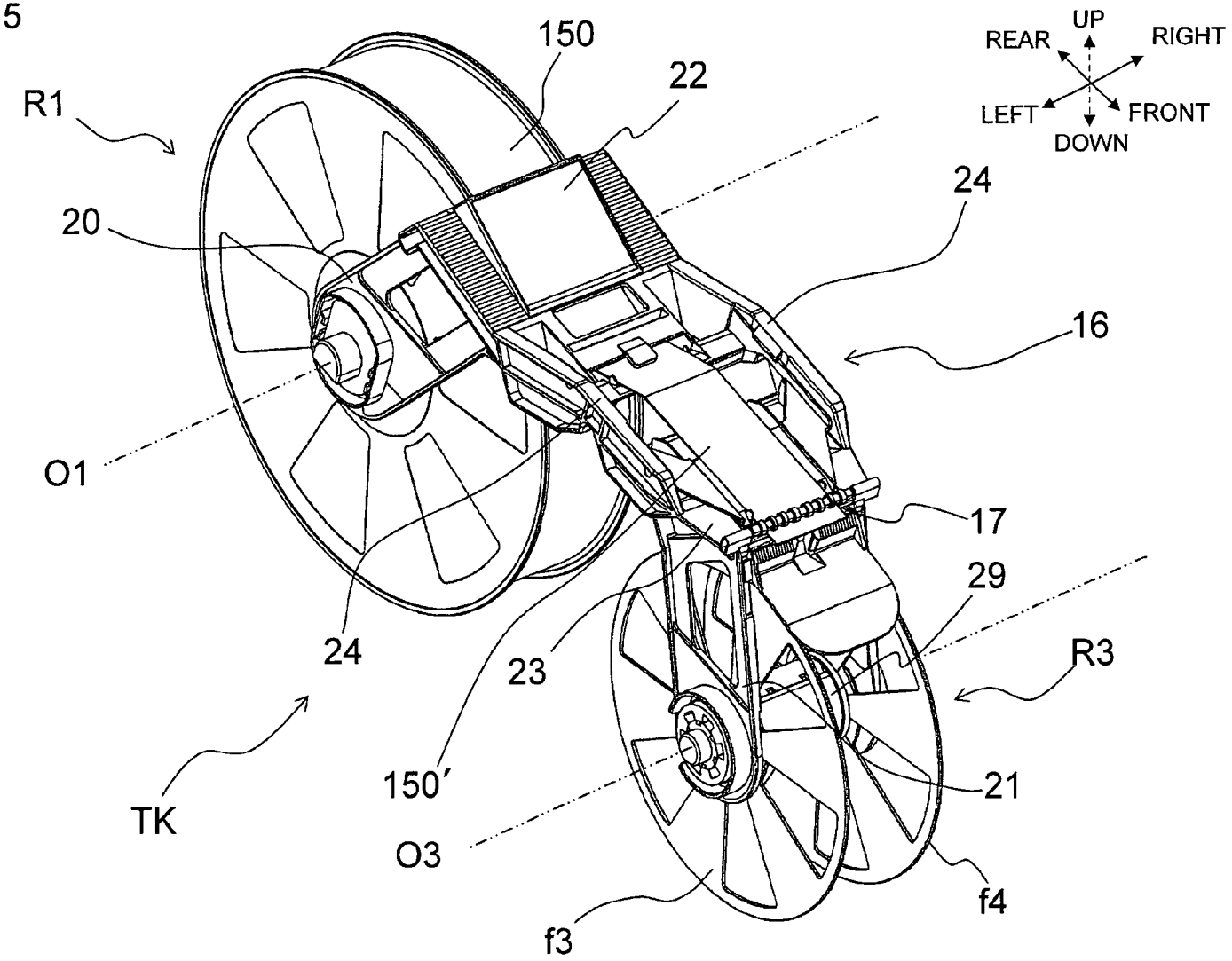
FIG. 5 is a perspective view showing the overall configuration of the tape cartridge.

That is, the tape cartridge TK comprises the first roll R1 and a connecting arm 16, as shown in FIG. 5. The connecting arm 16 comprises a left and right pair of first bracket parts 20, 20 disposed on the rearward side, and a left and right pair of second bracket parts 21, 21 disposed on the frontward side.

The first bracket parts 20, 20 are set so that the above described first roll R1 is sandwiched from both the left and right sides along the axis O1, holding the first roll R1 rotatably around the winding core 39 (refer to FIG. 9, FIG. 12, FIG. 13, and the like described later) with the tape cartridge TK mounted to the housing main body 2*a*. These first bracket parts 20, 20 are connected by a first connecting part 22 that is extended substantially along the left-right direction on the upper end, avoiding interference with the outer diameter of the first roll R1. Note that the tip end (rear end) of a print-receiving tape 150 on the transport direction upstream side is configured to be removable from the above described winding core 39 (details described later).

The first roll R1 is rotatable when the tape cartridge TK is mounted in the interior of the housing main body 2*a*. The first roll R1 winds the print-receiving tape 150 (comprising a print-receiving layer 154, a base layer 153, an adhesive layer 152, and a separation material layer 151 described later; refer to the enlarged view in FIG. 2) consumed by feed-out around the above described winding core 39 comprising the above described axis O1 in the left-right direction, in advance.

The first roll R1 is received in the first storage part 3 from above by the mounting of the above described tape cartridge TK and stored with the axis O1 of the winding of the print-receiving tape 150 in the left-right direction. Then, the first roll R1, stored in the first storage part 3 (with the tape cartridge TK mounted), rotates in a predetermined rotating direction (a direction A in FIG. 2) inside the first storage part 3, thereby feeding out the print-receiving tape 150.

This embodiment illustrates a case where a print-receiving tape 150 comprising adhesive is used. That is, the print-receiving tape 150 is layered in the order of the print-receiving layer 154, the base layer 153, the adhesive layer 152, and the separation material layer 151, from one side in the thickness direction (upward side in FIG. 2) toward the other side (downward side in FIG. 2). The print-receiving layer 154 is a layer in which a desired print part 155 (refer to the enlarged partial view in FIG. 2) is formed by the heat transfer of ink from the above described printing head 11. The adhesive layer 152 is a layer for affixing the base layer 153 to a suitable adherent (not shown). The separation material layer 151 is a layer that covers the adhesive layer 152.

Feeding Roller and Printing Head

Returning to FIGS. 2-4, the above described feeding roller 12 is disposed on a middle upward side of the first storage part 3 and the second storage part 5 of the housing main body 2*a*. The feeding roller 12 is driven by a feeding motor M1 disposed in the interior of the housing main body 2*a* via a gear mechanism (not shown), thereby feeding the print-receiving tape 150 fed out from the first roll R1 stored in the first storage part 3 in a tape posture in which the tape-width direction is in the left-right direction.

Further, the above described head holding part 10 disposed on the first opening/closing cover 8*a* comprises the above described printing head 11. The printing head 11, as described above, is capable of moving relatively closer to or farther away from the feeding roller 12 by the pivoting of the first opening/closing cover 8*a* around the pivot axis K1. That is, the printing head 11 moves closer to the feeding roller 12 when the first opening/closing cover 8*a* is closed, and farther away from the feeding roller 12 when the first opening/closing cover 8*a* is opened. This printing head 11 is disposed in a position of the head holding part 10 that faces the area above the feeding roller 12, with the first opening/closing cover 8*a* closed, sandwiching the print-receiving tape 150 fed by the feeding roller 12 in coordination with the feeding roller 12. Accordingly, when the first opening/closing cover 8*a* is closed, the printing head 11 and the feeding roller 12 are disposed facing each other in the up-down direction. Then, the printing head 11 forms the above described print part 155 on the print-receiving layer 154 of the print-receiving tape 150 sandwiched between the printing head 11 and the feeding roller 12 using an ink ribbon IB of an ink ribbon cartridge RK described later, thereby forming a tape 150' with print.

Ink Ribbon Cartridge

As shown in FIG. 2 and FIG. 3, the ink ribbon cartridge RK is detachably mounted in a second predetermined position 14, which is below the first opening/closing cover 8*a* (when closed) and above the tape cartridge TK in the housing main body 2*a*. This ink ribbon cartridge RK comprises a ribbon feed-out roll R4 around which is wound the unused ink ribbon IB in manner that enables feed-out, and a ribbon take-up roll R5. A rearward-side feed-out roll storage part 81 and a frontward-side take-up roll storage part 82 is coupled by a center coupling part (not shown) of the ink ribbon cartridge RK. The coupling part couples the above described take-up roll storage part 82 and the above described feed-out roll storage part 81 while exposing the above described ink ribbon IB fed out from the ribbon feed-out roll R4 to the outside of the ink ribbon cartridge RK.

The ribbon feed-out roll R4 is rotatably supported inside the feed-out roll storage part 81, and rotates in a predetermined rotating direction (a direction D in FIG. 2) with the ink ribbon cartridge RK mounted, thereby feeding out the ink ribbon IB for print formation by the printing head 11.

The ribbon take-up roll R5 is rotatably supported inside the take-up roll storage part 82 and rotates in a predetermined rotating direction (a direction E in FIG. 2) with the ink ribbon cartridge RK mounted, thereby taking up the used ink ribbon IB after print formation.

That is, in FIG. 2, the ink ribbon IB fed out from the ribbon feed-out roll R4 is disposed further on the printing head 11 side of the print-receiving tape 150 sandwiched between the printing head 11 and the feeding roller 12, contacting the area below the printing head 11. Then, after the ink of an ink ribbon IB is transferred to the print-receiving layer 154 of the print-receiving tape 150 by the heat from the printing head 11 to execute formation of the print part 155, the used ink ribbon IB is taken up on the ribbon take-up roll R5.

Separation Material Roll and Surrounding Area Thereof

As shown in FIG. 5, the connecting arm 16 of the tape cartridge TK comprises a peeling part 17 that includes a substantially horizontal slit shape, for example. This peeling part 17 is an area that peels the separation material layer 151 from the tape 150' with print fed out from the first roll R1 and fed to the frontward side. As shown in FIG. 2, the above described peeling part 17 peels the above described separation material layer 151 from the tape 150' with print on which print was formed as described above, thereby separating the separation material layer 151 and a tape 150" with print made of the other layers, i.e., the print-receiving layer 154, the base layer 153, and the adhesive layer 152.

The tape cartridge TK, as shown in FIG. 2 and FIG. 5, comprises the above described third roll R3 formed by winding the above described peeled separation material layer 151 around a winding core 29 comprising an axis O3. That is, the third roll R3 is received in the above described second storage part 5 from above by the mounting of the aforementioned tape cartridge TK and stored with the axis O3 in the left-right direction. Then, the winding core 29, stored in the second storage part 5 (with the tape cartridge TK mounted), is driven by a separation sheet take-up motor M3 disposed inside the housing main body 2*a* via a gear mechanism (refer to FIG. 6 and the like described later) and rotates in a predetermined rotating direction (a direction C in FIG. 2) inside the second storage part 5, thereby taking up the separation material layer 151.

At this time, as shown in FIG. 5, the above described second bracket parts 21, 21 of the tape cartridge TK are set so that the above described third roll R3 is sandwiched from both the left and right sides along the axis O3, holding the winding core 29 (in other words, the third roll R3) rotatably around the axis O3 with the tape cartridge TK mounted to the housing main body 2*a*. These second bracket parts 21, 21 are connected by a second connecting part 23 extended substantially along the left-right direction on the upper end. Then, the first bracket parts 20, 20 and the first connecting part 22 on the rearward side, and the second bracket parts 21, 21 and the second connecting part 23 on the frontward side are connected by a left and right pair of roll connecting beam parts 24, 24.

Further, FIG. 5 shows the state before the separation material layer 151 is wound around the winding core 29 and the third roll R3 is formed (the case of the unused tape cartridge TK). That is, FIG. 5 shows substantially circular roll flange parts f3, f4 disposed so as to sandwich both width-direction sides of the separation material layer 151, and conveniently denotes the location where the third roll R3 is formed using the reference number "R3."

Tape Roll with Print and Surrounding Area Thereof

Figure 4:
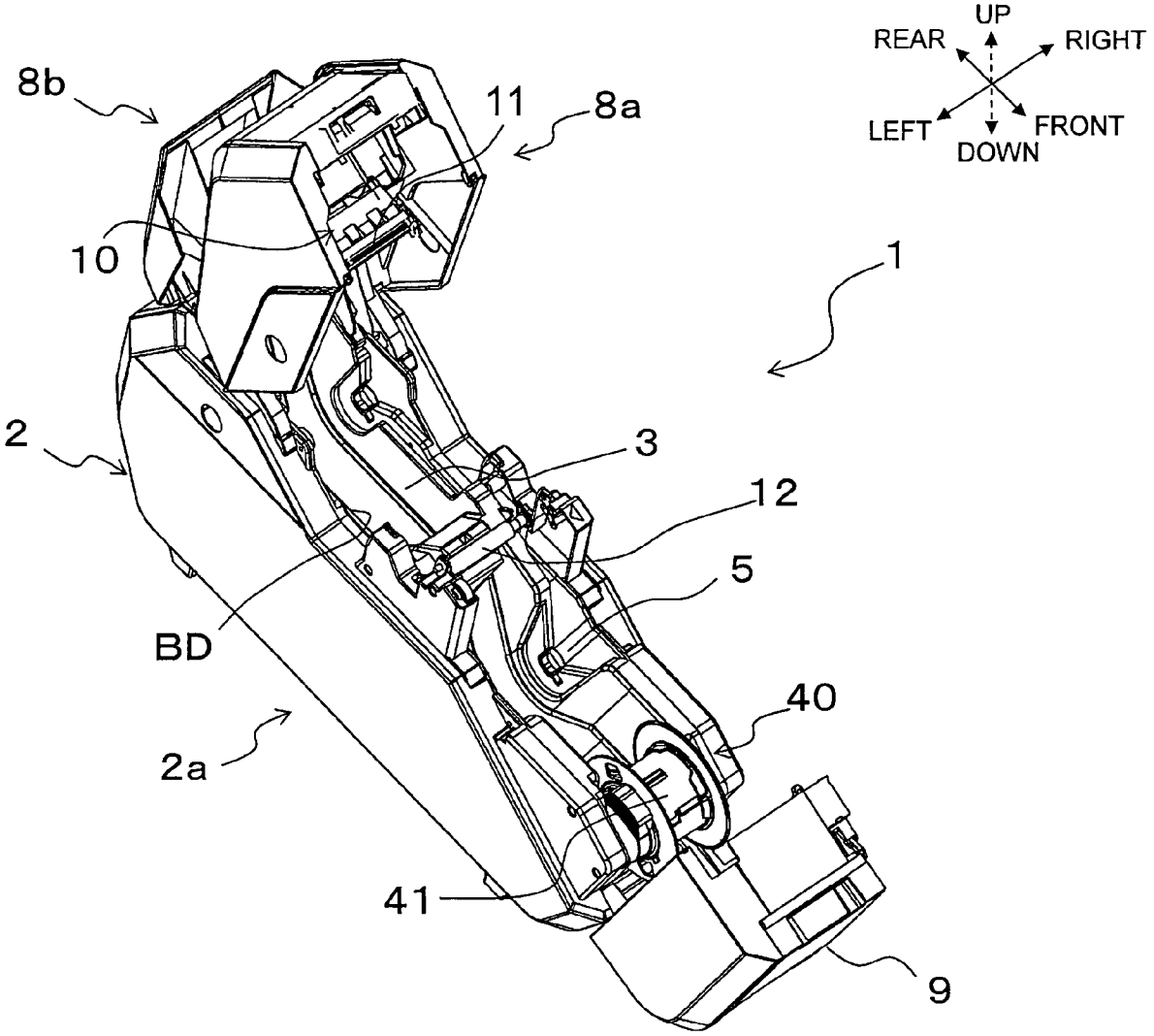
FIG. 4 is a perspective view showing the tape printer with the first, second, and frontward-side opening/closing covers open and the tape cartridge and ink ribbon cartridge removed.

On the other hand, as shown in FIG. 2 and FIG. 4, a take-up mechanism 40 comprising a winding core 41 for sequentially winding the above described tape 150" with print is received in the above described third storage part 4 from above. The take-up mechanism 40 is stored so that the above described winding core 41 is supported rotatably around an axis O2 of the winding of the tape 150" with print, with the axis O2 in the left-right direction. Then, with the take-up mechanism 40 stored in the third storage part 4, the winding core 41 is driven by an adhesive take-up motor M2 that is disposed in the interior of the housing main body 2*a* via a gear mechanism (refer to FIG. 6 described later) and rotates in a predetermined rotating direction (a direction B in FIG. 2) inside the third storage part 4, sequentially taking up and layering the tape 150" with print on the outer circumference side of the winding core 41. With this arrangement, the tape 150" with print is sequentially wound around the outer circumference side of the winding core 41, forming a second roll R2.

Cutter Mechanism

Further, as shown in FIG. 2, a cutter mechanism 30 is disposed on the downstream side of the printing head 11 and the upstream side of the second roll R2, along the tape transport direction.

The cutter mechanism 30, while not shown in detail, comprises a movable blade and a carriage that supports the movable blade and is capable of travelling in the tape-width direction (in other words, the left-right direction). Then, the carriage travels by the driving of a cutter motor MC (refer to FIG. 7 described later) and the movable blade moves in the tape-width direction, cutting the above described tape 150" with print in the width direction.

Gear Mechanisms Surrounding Motor

Hence, the above described gear mechanisms related to the above described separation sheet take-up motor M3 and adhesive take-up motor M2 will now be described along with a slip clutch (described later) disposed in combination with the respective gear mechanisms, using FIG. 6 and FIG. 7.

Gear Mechanism of Separation Sheet Take-Up Motor

Figure 6:
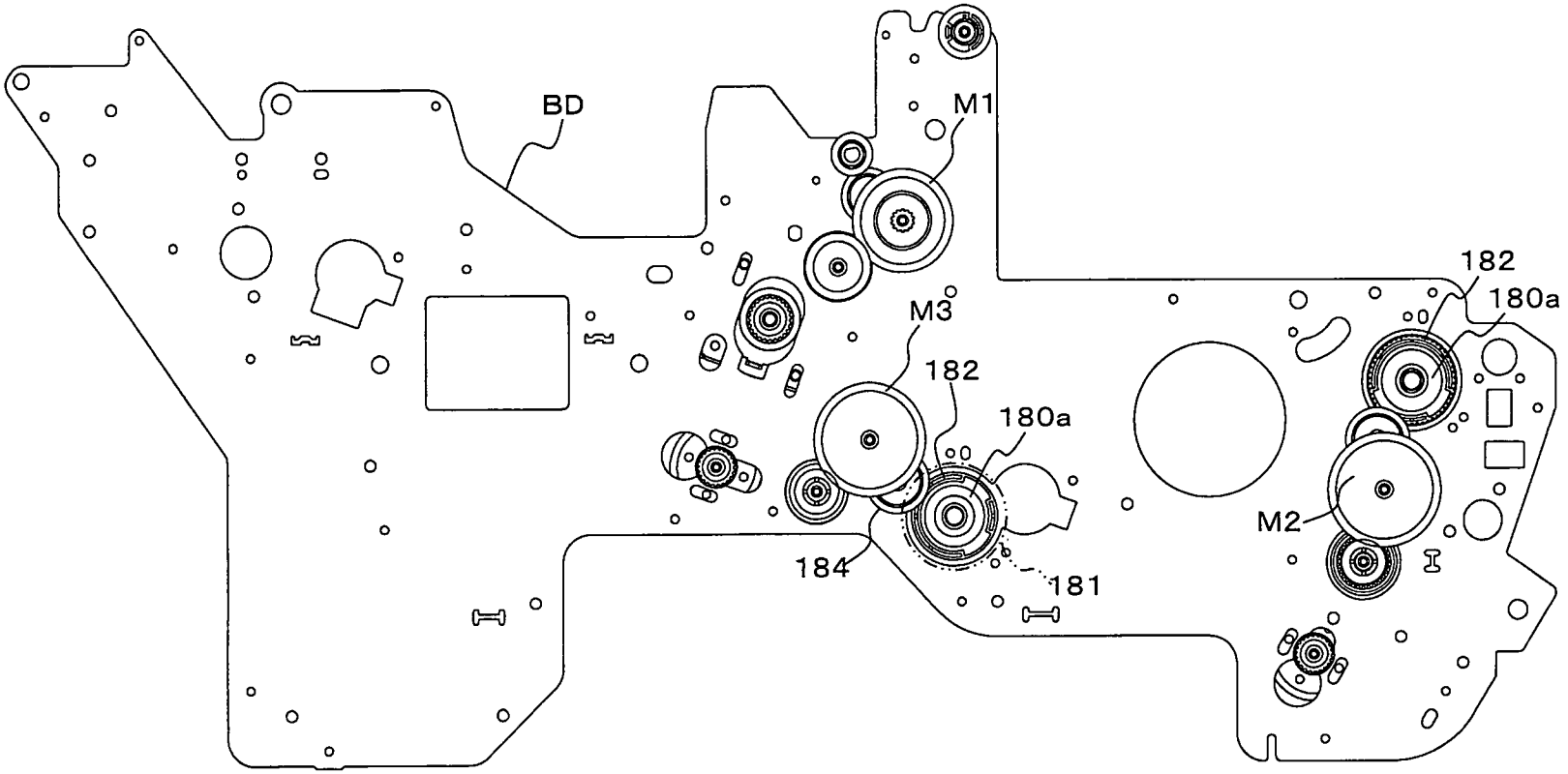
FIG. 6 is a side view showing the disposition of a gear mechanism and a slip clutch of a housing board.
Figure 7:
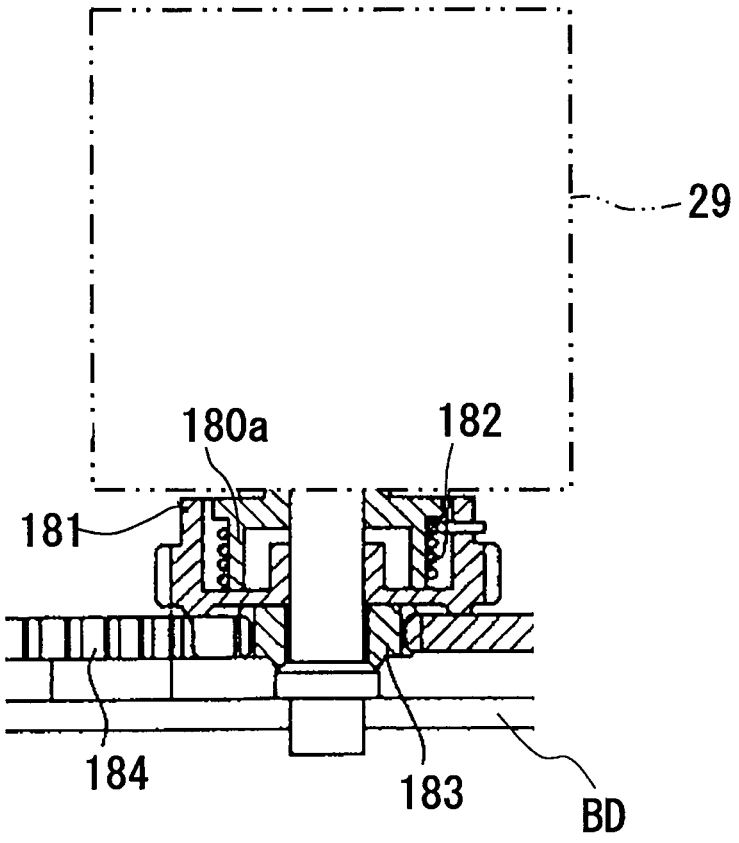
FIG. 7 is an essential section cross-sectional view showing the detailed structure of the slip clutch.

As shown in FIG. 6 and FIG. 7 (refer to the above described FIG. 4 as well), a rotating shaft 180*a* disposed on the end of the above described winding core 29 is rotatably supported by the above described housing board BD. The above described rotating shaft 180*a* is coupled with a gear 181 via a slip clutch 182 constituting a torque limiter. The slip clutch 182 is a coil spring wound around the rotating shaft 180*a*, with one end thereof press-contacting (applying winding pressure to) the rotating shaft 180*a* of the winding core 29 while the other end engages with the gear 181. At this time, a gear 183 that meshes with the above described gear 181 is disposed on the end of the rotating shaft 180*a*. The gear 183 is rotatably supported by the above described housing board BD, and is operationally coupled with the above described separation sheet take-up motor M3 via a gear 184.

When the gear 184 rotates by the driving force of the separation sheet take-up motor M3, the gear 183 rotates by the rotation of the gear 184, and the gear 181 rotates by the rotation of the gear 183. Then, if there is no load of an external force on the winding core 29, the friction (the tension force associated with contraction of the coil spring) between the slip clutch 182 and the rotating shaft 180*a* causes the rotation of the gear 181 to be entirely transmitted to the rotating shaft 180*a* and the winding core 29 to rotate along with the gear 181.

On the other hand, if there is a load of an external force on the winding core 29, the winding of the slip clutch 182 onto the rotating shaft 180*a* loosens (the tension force associated with the enlarged diameter of the coil spring releases), causing slippage between the rotating shaft 180*a* and the slip clutch 182. That is, (the rotation of the gear 181 is not entirely transmitted to the rotating shaft 180*a*, but rather) the rotating shaft 180*a* slips along with the winding core 29, causing a portion of the rotation of the gear 181 to be transmitted to the rotating shaft 180*a*. In other words, the section of the driving torque from the separation sheet take-up motor M3 that is not transmitted to the rotating shaft 180*a* is released as slippage of the slip clutch 182. As a result, the function as the torque limiter is fulfilled.

Gear Mechanism of Adhesive Take-Up Motor

On the other hand, the rotating shaft 180*a* disposed on the end of the winding core 41 of the above described take-up mechanism 40 is rotatably supported by the above described housing board BD. Although a detailed description is omitted, this rotating shaft 180*a* is also operationally coupled with the adhesive take-up motor M2 via a gear mechanism and slip clutch having the same configuration as described above. With this arrangement, in the same manner as described above, when the gear 184 rotates by the driving force of the adhesive take-up motor M2, the gear 183 rotates by the rotation of the gear 184, and the gear 181 rotates by the rotation of the gear 183. If there is a load of an external force on the winding core 41, slippage occurs between the rotating shaft 180*a* and the slip clutch 182, causing the rotating shaft 180*a* to slip along with the winding core 41, thereby transmitting a portion of the rotation of the gear 181 to the rotating shaft 180*a* and thus fulfilling the function of the above described torque limiter.

Overview of Action of Tape Printer

Next, an overview of the action of the tape printer 1 with the above described configuration will be described.

That is, when the tape cartridge TK is mounted in the above described first predetermined position 13, the first roll R1 is stored in the first storage part 3 positioned on the rearward side of the housing main body 2*a*, and the axis O3 side that forms the third roll R3 is stored in the second storage part 5 positioned on the frontward side of the housing main body 2*a*. Further, the take-up mechanism 40 for forming the second roll R2 is stored in the third storage part 4 positioned on the frontward side of the housing main body 2*a*.

In this state, the user manually peels the separation material layer 151 from the print-receiving tape 150 (printing has not yet begun at this point in time), and attaches the tip end of the tape made of the base layer 153 and the adhesive layer 152 to the winding core 41 of the above described take-up mechanism 40. Then, when the feeding roller 12 is driven, the print-receiving tape 150 fed out by the rotation of the first roll R1 stored in the first storage part 3 is fed to the frontward side. Then, desired print (the above described print part 155) is formed by the printing head 11 on the print-receiving layer 154 of the print-receiving tape 150 thus fed, thereby forming the tape 150' with print. When the tape 150' with print on which print was formed is further fed to the frontward side and fed to the peeling part 17, the separation material layer 151 is peeled at the peeling part 17, forming the tape 150" with print. The peeled separation material layer 151 is fed to the downward side, introduced to and wound inside the second storage part 5, forming the third roll R3.

On the other hand, the tape 150" with print from which the separation material layer 151 has been peeled is further fed to the frontward side, introduced to the third storage part 4, and wound around the outer circumference side of the winding core 41 of the take-up mechanism 40 inside the third storage part 4, thereby forming the second roll R2. At this time, the cutter mechanism 30 disposed on the transport direction downstream side (that is, the frontward side) cuts the tape 150" with print. With this arrangement, the tape 150" with print wound around the second roll R2 can be cut based on a timing desired by the user and the second roll R2 can be removed from the third storage part 4 after cutting.

Note that, at this time, although not explained by illustration, a non-adhesive tape (one without the above described adhesive layer 152 and separation material layer 151) may be wound around the first roll R1. In this case as well, the first roll R1 which winds the non-adhesive tape is received in the first storage part 3 from above by the mounting of the tape cartridge TK and stored with the axis O1 of the winding of the non-adhesive tape in the left-right direction. Then, the first roll R1, stored in the first storage part 3 (with the tape cartridge TK mounted), rotates in a predetermined rotating direction (the direction A in FIG. 2) inside the first storage part 3, thereby feeding out the non-adhesive tape.

Further, at this time, a shoot 15 (refer to FIG. 2) for switching the feeding path of the above described non-adhesive tape (or the above described print-receiving tape 150) between a side toward the second roll R2 and a side toward the discharging exit (not shown) may be disposed. That is, the non-adhesive tape after print formation (or the tape 150" with print) may be discharged as is from the discharging exit (not shown) disposed on the second opening/closing cover 8*b* side, for example, of the housing 2 to the outside of the housing 2 without being wound inside the third storage part 4 as described above by switching the tape path by a switch operation of the shoot 15 using a switch lever (not shown).

Control System

Figure 8:
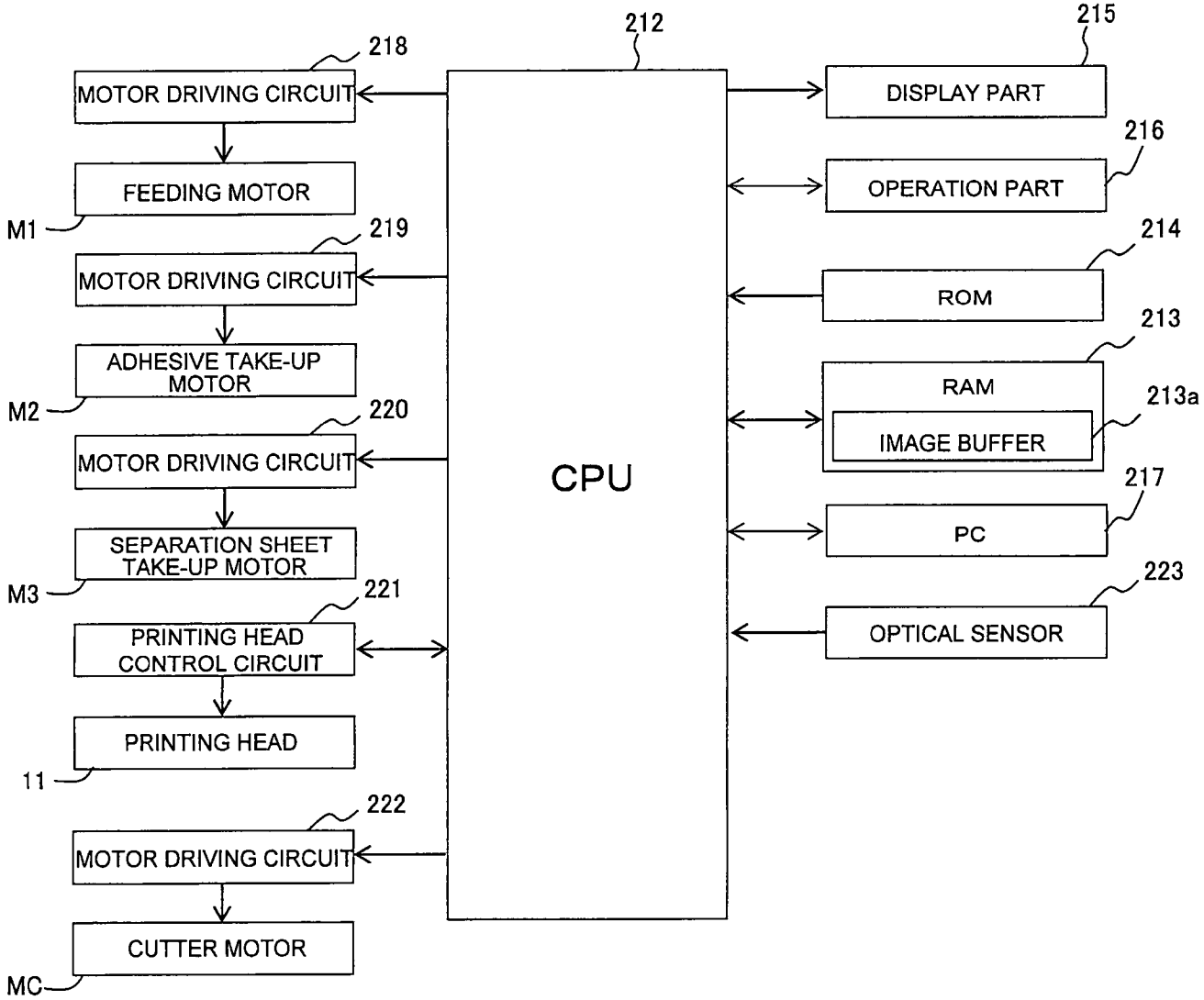
FIG. 8 is a function block diagram showing the configuration of the control system of the tape printer.

Next, the control system of the tape printer 1 will be described using FIG. 8. In FIG. 8, the tape printer 1 comprises a CPU 212 that constitutes a control circuit that performs predetermined computations. The CPU 212 is connected to a RAM 213, a ROM 214, a PC 217, and an optical sensor 223. The CPU 212 performs signal processing in accordance with a program stored in advance in the ROM 214 while utilizing a temporary storage function of the RAM 213, and controls the entire tape printer 1 accordingly.

Further, the CPU 212 is connected to a motor driving circuit 218 that controls the driving of the above described feeding motor M1 that drives the above described feeding roller 12, a motor driving circuit 219 that controls the driving of the above described adhesive take-up motor M2 that drives the winding core 41 of the above described take-up mechanism 40, a motor driving circuit 220 that controls the driving of the above described separation sheet take-up motor M3 that drives the above described third roll R3, a printing head control circuit 221 that controls the current conduction of the heating elements (not shown) of the above described printing head 11, a motor driving circuit 222 that controls the driving of the cutter motor MC that causes the carriage comprising the above described movable blade to travel, a display part 215 that performs suitable displays, and an operation part 216 that permits suitable operation input by the user. Further, while the CPU 212 is connected to the PC 217 serving as an external terminal in this example, the CPU 212 does not need to be connected in a case where the tape printer 1 operates alone (since it is a so-called all-in-one type).

The above described optical sensor 223 constitutes a so-called known rotary encoder that projects incident light from a light-emitting part onto the above described winding core 41, and receives the reflected light thereof by a light-receiving part, for example. The optical sensor 223, based on the above described configuration, outputs a pulse waveform (encoder pulse) that indicates the number of rotations of the third roll R3, in accordance with the result of light reception by the above described light-receiving part, to the CPU 212 (refer to FIG. 13 described later).

The ROM 214 stores control programs for executing predetermined control processing (including programs that execute the flow processing in FIG. 14 described later). The RAM 213 comprises an image buffer 213*a* that expands print data (refer to step S204 described later) generated in correspondence with an operation of the above described operation part 216 (or the above described PC 217) by the user into dot pattern data for printing in a predetermined print area of the above described print-receiving layer 154, and stores the data, for example. The CPU 212 repeatedly prints one image corresponding to the above described dot pattern data stored in the image buffer 213*a* on the print-receiving tape 150 by the printing head 11 while feeding out the print-receiving tape 150 by the feeding roller 12, based on the above described control programs.

Special Characteristics of this Embodiment (1)

In the above basic configuration, the first special characteristic of this embodiment lies in the technique for controlling the separation sheet take-up motor M3 so as to generate a driving torque of a size that corresponds to the increasing outer diameter of the separation material layer 151 of the third roll R3 and is appropriate for take-up. In the following, details on the functions will be described in order.

Figure 9A:
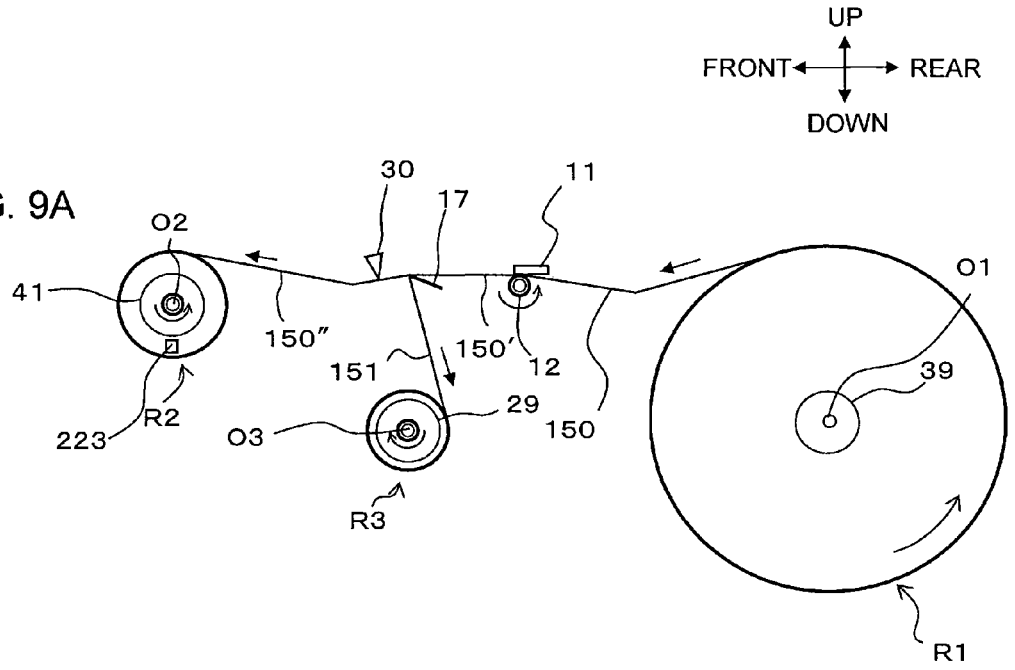
FIG. 9A is an explanatory view showing the tape feeding, print formation, tape take-up behavior, and the like during printing execution.

According to this embodiment, as already described, the print-receiving tape 150 is fed by the feeding roller 12 and desired print is formed on the fed print-receiving tape 150 by the printing head 11 to generate a tape 150' with print, as shown in FIG. 9A. Then, the separation material layer 151 peeled from the tape 150' with print is sequentially taken up on the outer circumference part of the winding core 29 driven by the separation sheet take-up motor M3, forming the roll-shaped third roll R3.

Figure 9B:
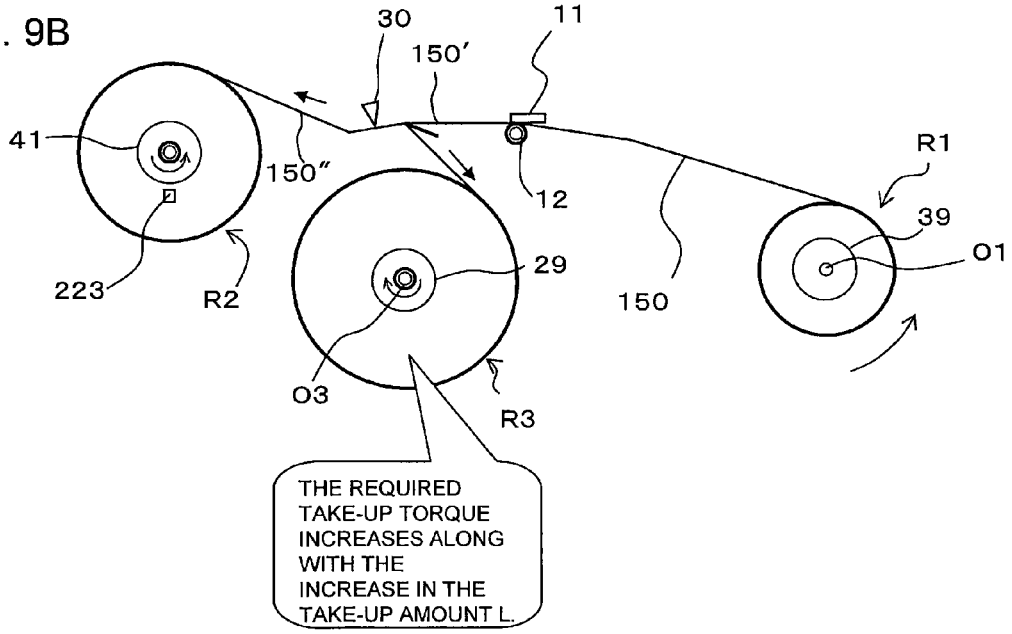
FIG. 9B is an explanatory view showing the tape feeding, print formation, tape take-up behavior, and the like during printing execution.

Then, when the winding core 29 performs take-up as described above, the above described separation material layer 151 is layered in the radial direction as time passes, increasing the outer diameter of the third roll R3, as shown in FIG. 9B. Accordingly, since a relatively large torque is required for smooth take-up, in this embodiment, constant torque control with respect to the separation sheet take-up motor M3 is performed by the motor driving circuit 220. This constant torque control will now be described using FIG. 10.

Constant Torque Control by Motor Driving Circuit

Figure 10:
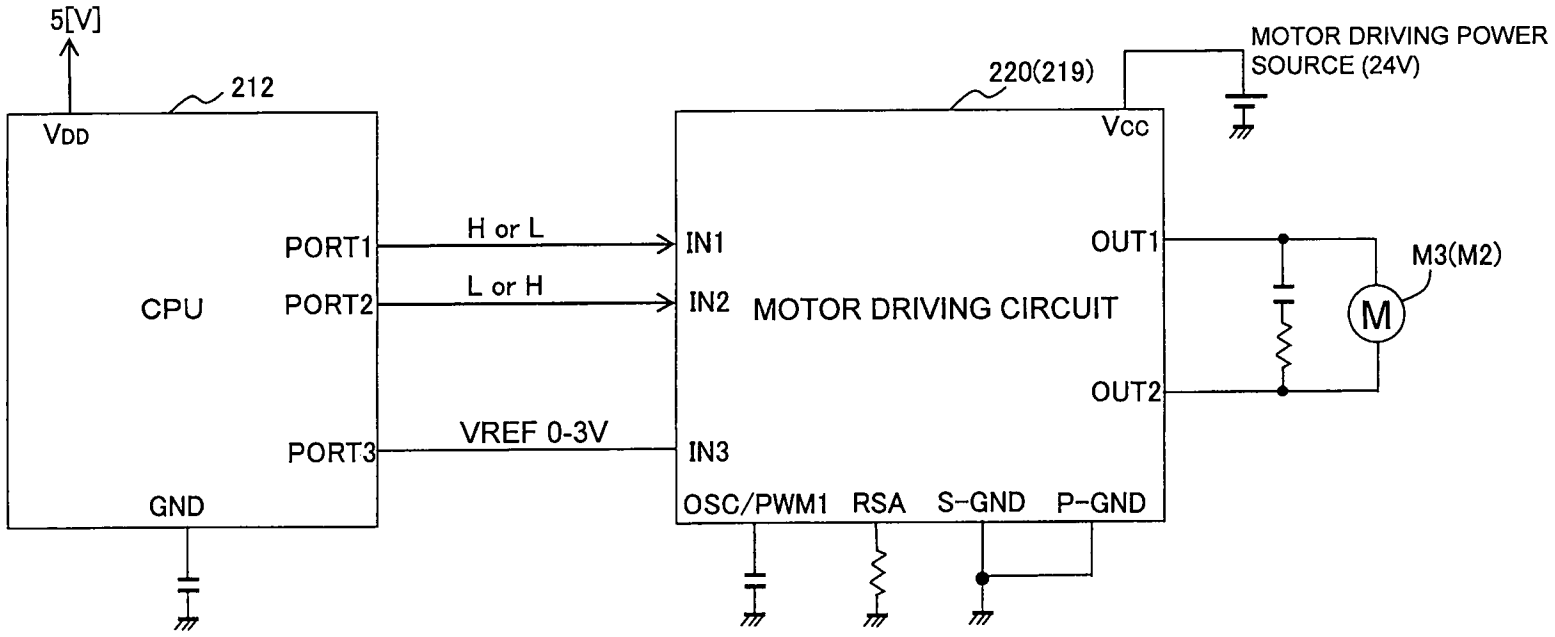
FIG. 10 is a circuit diagram showing the circuit connection configuration between the control circuit and motor driving circuit.

In FIG. 10, the above described CPU 212 comprises three communication ports (PORT1, PORT2, PORT3), and each transmits a signal to an input terminal (IN1, IN2, IN3) of the motor driving circuit 220. Further, the motor driving circuit 220 comprises output terminals OUT1, OUT2, with the output terminal OUT1 connected to one polarity of the separation sheet take-up motor M3, and the output terminal OUT2 connected to the other polarity.

The above described communication port PORT1 transmits a high level signal H or a low level signal L to the input terminals Ni, IN2, and the communication port PORT2 transmits the high level signal H or the low level signal L to the input terminal IN2, using the level opposite that of the communication port PORT1. For example, the communication port PORT1 transmits the high level signal H to the input terminal IN1 and the communication port PORT2 transmits the low level signal L to the input terminal IN2, thereby rotating the separation sheet take-up motor M3 in the forward direction. On the other hand, the communication port PORT1 transmits the low level signal L to the input terminal IN1 and the communication port PORT2 transmits the high level signal H to the input terminal IN2, thereby rotating the separation sheet take-up motor M3 in the reverse direction.

The above described communication port PORT3 of the CPU 212 inputs a voltage command value Vref (0-3V, for example), in which a voltage has been set in advance, to the above described input terminal IN3. With this arrangement, the motor driving circuit 220 performs constant torque control so that the driving torque of the separation sheet take-up motor M3 is a constant value corresponding to the voltage command value Vref.

Note that, although a detailed description is omitted, the motor driving circuit 219 also performs constant torque control in the same manner as described above with respect to the adhesive take-up motor M2 (refer to FIG. 10).

Problem when Executing Constant Torque Control

Figure 11:
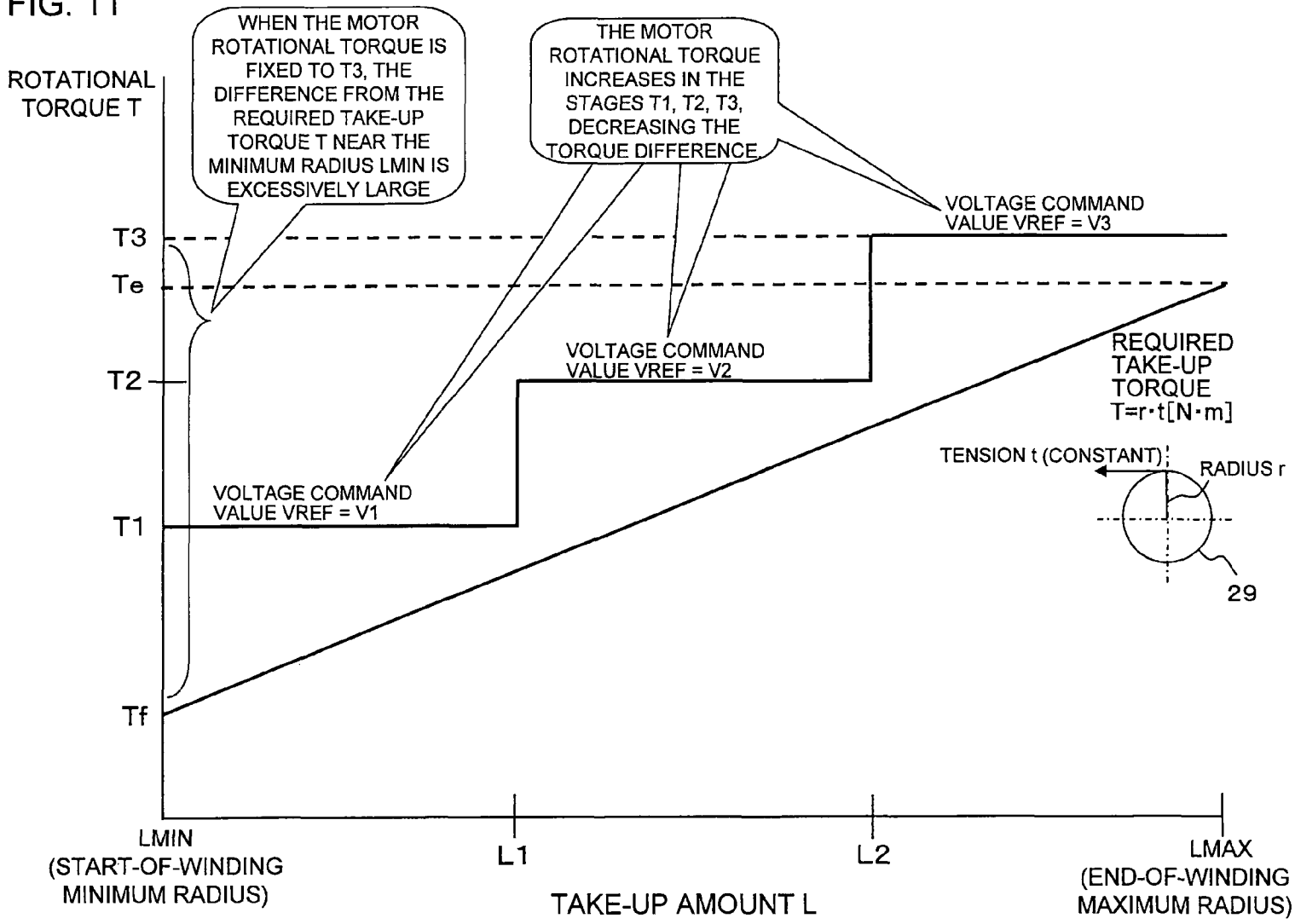
FIG. 11 is a graph showing the change in the take-up torque required for take-up with respect to the change in the take-up amount of the third roll, and the mode in which the rotational torque of the separation sheet take-up motor is switched in stages.

Returning to FIG. 9B, the outer diameter of the tape layers around the winding core 29 (that is, the roll outer diameter of the third roll R3) gradually increases by the advancement of take-up as described above. FIG. 11 shows the relationship between a take-up amount L on the winding core 29 and a torque T at this time. As shown in FIG. 11, the required take-up torque T=r·t [N/m] (r: Radius of winding core 29, t: Constant tension) increases along with the increase in the take-up amount L on the winding core 29. As described above, the slip clutch 182 is disposed on the rotating shaft 180*a* of the winding core 29 and therefore, due to its function as the aforementioned torque limiter, the difference between the rotation of the gear 181 transmitted by the rotational driving force of the separation sheet take-up motor M3 based on the above described constant torque control, and the rotation of the above described rotating shaft 180*a* corresponding to the above described required take-up torque T is permitted by the slippage of the slip clutch 182. Then, to reliably ensure smooth take-up when the take-up amount L becomes a maximum value Lmax at the end of take-up on the third roll R3 and the roll outer diameter becomes the maximum outer diameter, the voltage command value Vref that imparts a large driving torque corresponding to the maximum outer diameter needs to be input from the CPU 212 to the motor driving circuit 220.

Nevertheless, as shown in FIG. 11, immediately after the start and during the initial period of take-up of the separation material layer 151 by the winding core 29, the outer diameter of the separation material layer 151 around the above described winding core 29 (in other words, the outer diameter of the third roll R3) is small, and so the above described required take-up torque T is also small (for example, the value T of the required take-up torque at a take-up amount Lmin is Tf). Accordingly, when the voltage command value Vref corresponding to the maximum outer diameter is input to the motor driving circuit 220 as described above immediately after the start and during the initial period of take-up, the separation sheet take-up motor M3 wastefully generates a large torque that actually should not be required. For example, in the example shown, when the driving torque T of the separation sheet take-up motor M3 is fixed to the torque T3 corresponding to the time of the above described maximum outer diameter, (that is, the voltage command value of the motor driving circuit 220 is fixed to Vref=V3), the torque difference T3−Tf from the above described required take-up torque becomes excessively large near the above described minimum outer diameter (take-up amount Lmin). In particular, the slippage amount of the aforementioned slip clutch 182 significantly increases, possibly decreasing the durability of the slip clutch 182.

Switching the Voltage Command Value

Hence, in this embodiment, the voltage command value Vref output to the motor driving circuit 220 is switched in stages in accordance with the above described take-up amount L calculated by a known technique (in this example, based on the tape feeding amount detected by the number of pulses included in the control pulse signal output to the feeding motor M1, which is a pulse motor).

Figure 14:
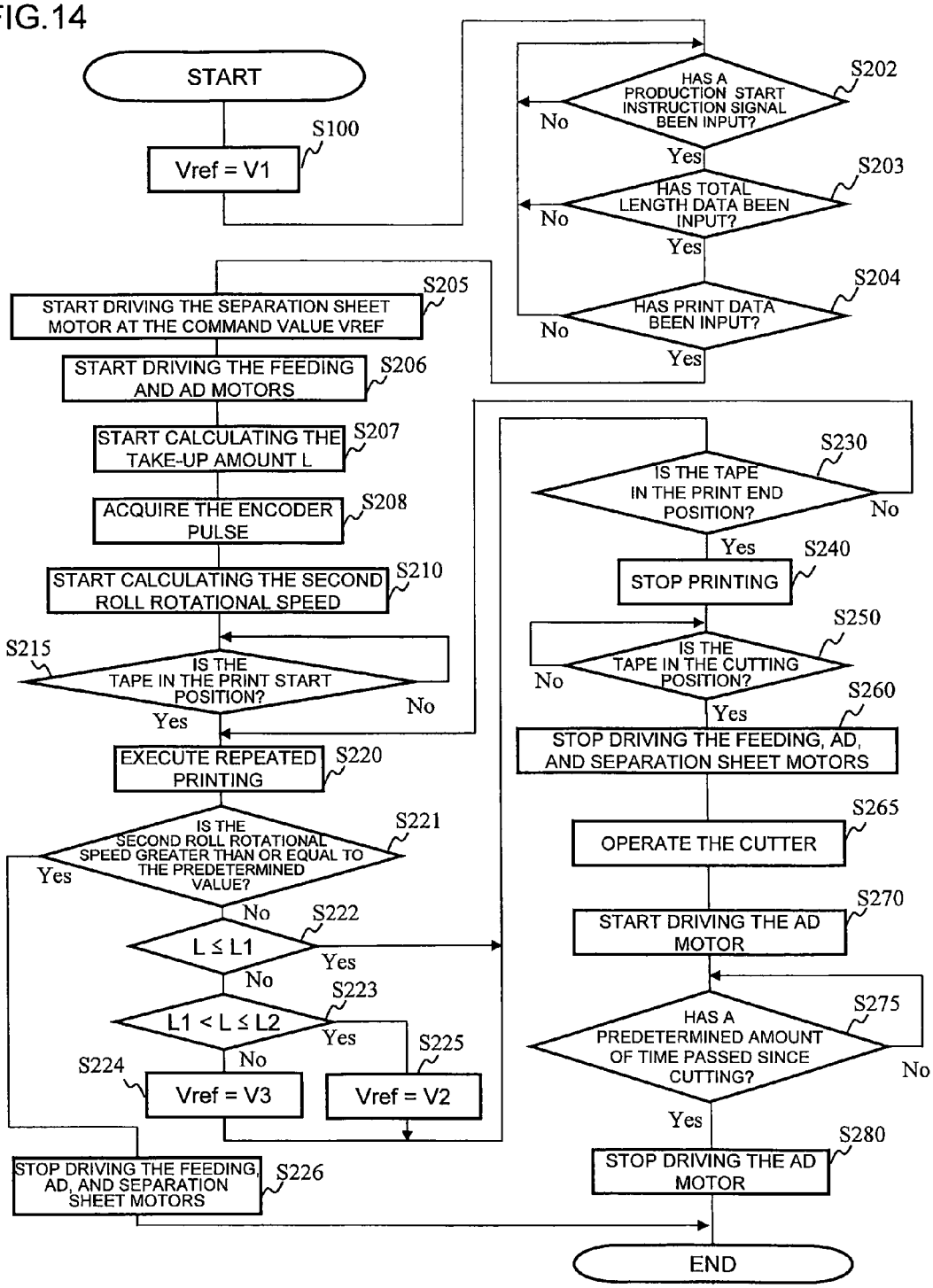
FIG. 14 is a flowchart showing the control procedure executed by the CPU.

Specifically, from the time the detected take-up amount L is the relatively small Lmin, as in the above described immediately after the start and during the initial period of take-up, the voltage command value Vref output to the above described motor driving circuit 220 is switched in the stages V1→V2→V3 as the detected take-up amount L increases and proceeds to the end-of-winding maximum diameter Lmax via a first predetermined value L1 (refer to FIG. 14 described later) and a second predetermined value L2 (refer to FIG. 14 described later). Note that, as described above, the driving torque T3 corresponding to the voltage command value Vref=V3 is set so as to become slightly larger than the required take-up torque T corresponding to the end-of-winding maximum diameter Lmax.

Generating the Second Roll by Take-Up on the Winding Core of the Tape with Print As shown in the above described FIG. 9B, when the separation material layer 151 peeled from the tape 150' with print is taken up, the tape 150" with print from which the separation material layer 151 has been peeled is similarly sequentially taken up on the outer circumference part of the winding core 41 of the take-up mechanism 40, forming the roll-shaped second roll R2.

Subsequently, once the take-up of the tape 150" with print in an amount desired by the user has ended (in other words, once the above described take-up amount has reached Lmax), as shown in FIG. 12A, the feeding roller 12, the winding core 41, and the winding core 29 all stop rotating, thereby stopping the feed-out and feeding of the above described print-receiving tape 150, the feeding of the tape 150' with print, and the feeding and take-up of the tape 150" with print. Note that print formation is stopped in advance of the above described stop so that the area between the cutter mechanism 30 and the printing head 11 becomes the above described tape 150-0, where print is not formed, in this stopped state. In this state, the cutter mechanism 30 cuts the tape 150" with print between the feeding roller 12 and the second roll R2.

Subsequently, the adhesive take-up motor M2 is controlled so that the winding core 41 (in other words, the second roll R2) stops after rotation for a predetermined amount of time in the take-up direction (with the feeding roller 12 stopped as is). That is, after completion of the cutting of the tape 150" with print by the cutter mechanism 30, the second roll R2 does not stop immediately, but rather after rotation for a predetermined amount of time. With this arrangement, the second roll R2 is rotated a predetermined amount after cutting completion, and the end edge of the tape 150" with print generated by cutting is reliably taken up on the second roll R2 (refer to FIG. 12B).

Note that while the aforementioned example has described an illustrative scenario in which the present disclosure is applied to the control of the separation sheet take-up motor M3 when the separation material layer 151 (as a portion of layers of the above described print-receiving tape) is taken up on the third roll R3 by the rotation of the winding core 29, the present disclosure is not limited thereto. That is, the aforementioned technique may also be applied to the control of the adhesive take-up motor M2 when the print-receiving tape (in other words, the tape 150" with print) after the separation material layer 151 has been peeled is taken up on the second roll R2 by the rotation of the winding core 41 (refer to FIG. 10). In this case as well, the same advantages are achieved.

Special Characteristics of this Embodiment (2)

The second special characteristic of this embodiment lies in the tape end detection technique when the print-receiving tape 150 of the first roll R1 is consumed and reaches the tape end by the print formation and advancement of take-up such as described above. In the following, details on the functions will be described in order.

The above described print-receiving tape 150 of the first roll R1 is consumed as the take-up on the second roll R2 of the tape 150" with print is performed as described above (refer to FIG. 13A), at last reaching the tape end.

Hence, according to this embodiment, the printing head 11 performs the above described print formation by heat transfer by the ink ribbon IB as described above. In this case, when feeding of the print-receiving tape 150 stops according to the above described tape end, the feeding of the ink ribbon IB also stops in linkage thereto, causing the durability of the ink ribbon IB to possibly decrease due to the high heat of the printing head 11. Hence, according to the tape printer 1 in this embodiment, in order to avoid this, the tip end (rear end) of the print-receiving tape 150 on the transport direction upstream side is configured to be removable from the winding core 39 of the first roll R1, as described above. In such a case, when the first roll R1 reaches the tape end due to the above described consumption of the print-receiving tape 150, the above described rear end of the print-receiving tape 150 comes off the winding core 39 by the action of the driving force of the winding core 41 and the feeding roller 12 (refer to FIG. 13B), becomes a free end, and advances to the transport direction downstream side. When the above described rear end that has further advanced to the downstream side passes between the printing head 11 and the feeding roller 12, the tension with respect to the print-receiving tape 150 decreases, sharply increasing the number of rotations of the winding core 41 that performs the take-up of the tape 150" with print, as shown in FIG. 13C.

According to this embodiment, utilizing the above, the CPU 212 determines whether or not the first roll R1 has reached the tape end based on the detection result of the number of rotations (specifically, the number of rotations per unit time; that is, the rotating speed; hereinafter the same) of the winding core 41 by the above described optical sensor 223.

Figure 13A:
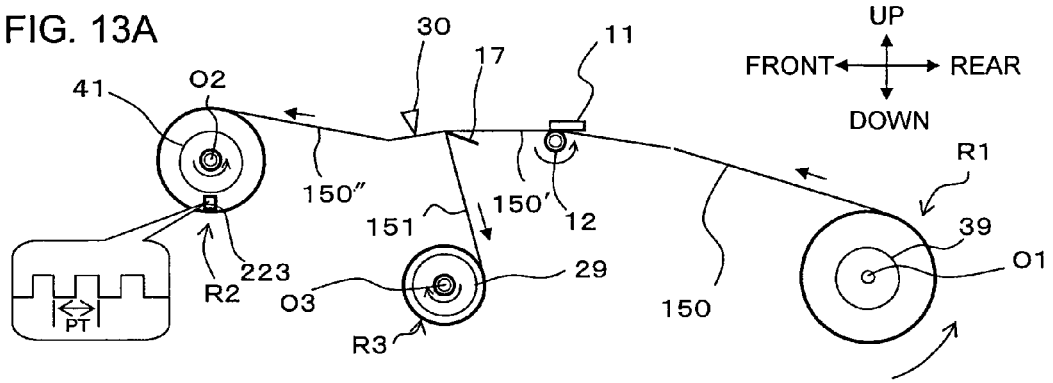
FIG. 13A is an explanatory view showing the tape feeding, cutting, take-up behavior, and the like when the tape runs out during printing execution.
Figure 13B:
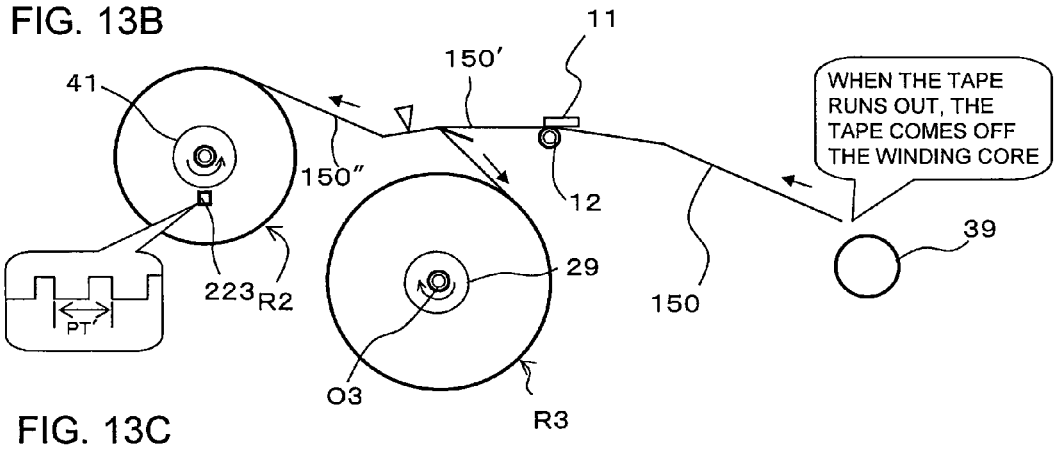
FIG. 13B is an explanatory view showing the tape feeding, cutting, take-up behavior, and the like when the tape runs out during printing execution.

That is, as shown in the above described FIG. 13A, in the stage of the initial period of take-up on the second roll R2 of the tape 150" with print, the pulse cycle detected by the optical sensor 223 is a relative long PT. Subsequently, as shown in FIG. 3B, immediately after the first roll R1 reaches the tape end and the above described rear end of the print-receiving tape 150 comes off the winding core 39 by the above described consumption of the print-receiving tape 150, the rear end of the print-receiving tape 150 and nearby area are left sandwiched between the printing head 11 and the feeding roller 12, and therefore a pulse cycle PT' detected by the above described optical sensor 223 is somewhat larger than the pulse cycle PT (in the same manner as immediately before the above described rear end comes off the winding core 39).

Figure 13C:
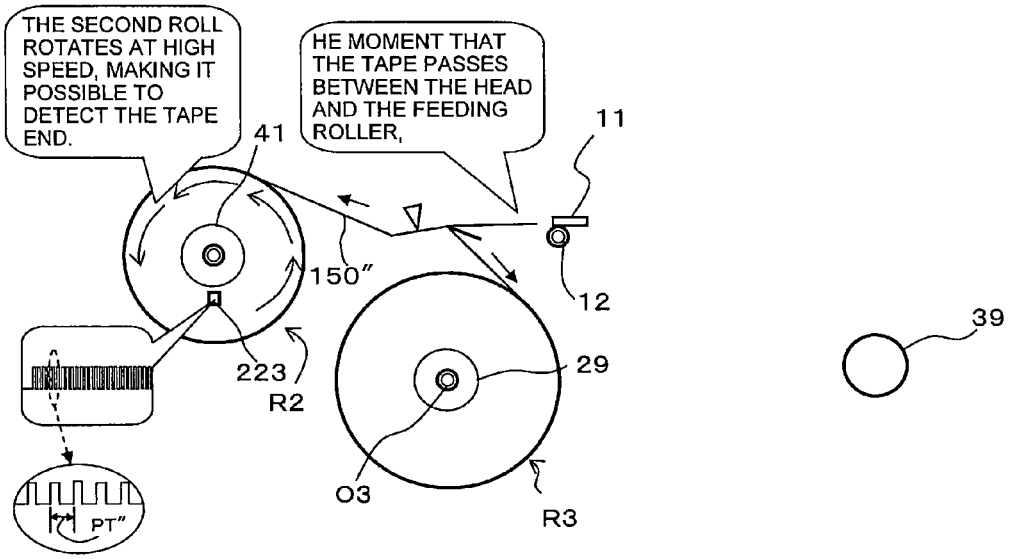
FIG. 13C is an explanatory view showing the tape feeding, cutting, take-up behavior, and the like when the tape runs out during printing execution.

However, when the above described rear end of the print-receiving tape 150 that has further advanced to the downstream side from the above described state passes between the printing head 11 and the feeding roller 12, the tension t with respect to the print-receiving tape 150 decreases all at once, sharply increasing the number of rotations of the winding core 41 that performs the take-up of the tape 150" with print, as shown in FIG. 13C. As a result, a pulse cycle PT" detected by the optical sensor 223 becomes extremely small as shown (PT"<<PT, PT'). According to this embodiment, it is possible to thus reliably detect that the print-receiving tape 150 of the first roll R1 has reached the tape end based on a sharp increase in the number of rotations of the winding core 41 as described above.

Control Flow

The following describes the processing content executed by the CPU 212 for achieving the above described technique, using the flow in FIG. 14. Note that, in FIG. 14, the name of each component is suitably abbreviated.

In FIG. 14, the flow is started by the user turning ON the power of the tape printer 1, for example ("START" position).

First, in step S100, the CPU 212 transmits the above described voltage command value Vref=V1 to the motor driving circuit 220. This command value is a value corresponding to the above described driving torque T1 of the separation sheet take-up motor M3 (refer to the above described FIG. 11).

Subsequently, in step S202, the CPU 212 determines whether or not a production start instruction signal corresponding to a production start operation for the above described second roll R2 performed by the user using the operation part 216 (or the above described PC 217) has been input. If the above described production start instruction signal has not been input, the condition of step S202 is not satisfied (S202: NO), and the flow loops back and enters a standby state. If the above described production start instruction signal has been input, the condition of step S202 is satisfied (S202: YES), and the flow proceeds to step S203.

In step S203, the CPU 212 determines whether or not the total length data indicating the length of the printed matter to be produced (in other words, the total length along the transport direction of the above described tape 150" with print to be generated) has been input in accordance with an operation by the user using the operation part 216 (or the above described PC 217). If the above described total length data corresponding to the length intended by the user has not been input, the condition of step S203 is not satisfied (S203: NO), the flow returns to the above described step S202, and the same procedure is repeated. If the above described total length data has been input, the condition of step S203 is satisfied (S203: YES), and the flow proceeds to step S204.

In step S204, the CPU 212 determines whether or not print data indicating one image desired by the user, to be formed into print on the above described print-receiving tape 150 (repeatedly formed into print in the tape length direction in this example), has been input in accordance with an operation by the user using the operation part 216 (or the above described PC 217). If the print data has not been input, the condition of step S204 is not satisfied (S204: NO), the flow returns to the above described step S202, and the same procedure is repeated. If the above described print data has been input, the condition of step S204 is satisfied (S204: YES), and the flow proceeds to step S205.

Subsequently, in step S205, the CPU 212 outputs the above described command value Vref as the control signal to the motor driving circuit 220 and starts the driving of the separation sheet take-up motor M3. Further, in the subsequent step S206, the CPU 212 outputs a control signal to the motor driving circuits 218, 219, and starts the driving of the above described feeding motor M1 and adhesive take-up motor M2 (abbreviated as "AD motor" in the figure). As a result, the feeding of the above described print-receiving tape 150, the tape 150' with print, and the tape 150" with print (hereinafter suitably simply referred to as "tape feeding"), and the take-up of the above described tape 150" with print is started.

Subsequently, the flow proceeds to step S207 where the CPU 212 starts calculation of the take-up amount L of the third roll R3 based on the number of pulses of the control pulse signal to the feeding motor M1 during the above described tape feeding started in the above described step S205 and step S206, as described above (thereafter, the calculation is continued).

Then, in step S208, the CPU 212 starts acquiring the above described encoder pulse from the above described optical sensor 223 for detecting the number of rotations of the winding core 41 of the second roll R2 (thereafter, acquisition of the encoder pulse is continued).

Subsequently, in step S210, the CPU 212 starts calculation of the number of rotations of the winding core 41 of the second roll R2 based on the encoder pulse acquired in the above described step S208 (thereafter, calculation of the number of rotations is continued).

Then, in step S215, the CPU 212 determines whether or not the above described tape feeding has arrived where the printing head 11 faces the corresponding print start position by a known technique, based on the print data acquired in the above described step S204. If the feeding has not arrived at the print start position, the condition is not satisfied (S215: NO), and the flow loops back and enters a standby state. If the feeding has arrived at the print start position, the condition of step S215 is satisfied (S215: YES), and the flow proceeds to step S220.

In step S220, the CPU 212 outputs a control signal to the printing head control circuit 221, conducts current to the heating elements of the printing head 11, and starts repeated print formation (repeated formation of the same print part 155) on the above described print-receiving tape 150 as one image corresponding to the print data input in the above described step S204.

In step S221, the CPU 212 determines whether or not the number of rotations of the second roll R2 for which calculation was started in the above described step S210 is greater than or equal to a predetermined threshold value (for example, a predetermined value somewhat smaller than the number of rotations when the rear end of the print-receiving tape 150 passes between the feeding roller 12 and the printing head 11, shown in the above described FIG. 13C). If the number of rotations has not reached a value greater than or equal to the above described predetermined value, the condition of step S221 is not satisfied (S221: NO), and the flow proceeds to step S222. If the number of rotations has reached a value greater than or equal to the predetermined value, the condition of step S221 is satisfied (S221: YES), and the flow proceeds to step S226.

In step S226, the CPU 212 outputs a control signal to the motor driving circuits 218, 219, 220, and stops the driving of the feeding motor M1, the adhesive take-up motor M2, and the separation sheet take-up motor M3. With this arrangement, the feeding of the above described print-receiving tape 150, the tape 150' with print, and the tape 150" with print (including the above described tape 150-0 as well) is stopped. Subsequently, the process terminates here.

On the other hand, in step S222, the CPU 212 determines whether or not the take-up amount L of the third roll R3 for which calculation was started in the above described step S207 is less than or equal to the above described first predetermined value L1. If L>L1, the condition of step S222 is not satisfied (S222: NO) and the flow proceeds to step S223. If the take-up amount L≤L1, the condition of step S222 is satisfied (S222: YES), and the flow proceeds to step S230 described later.

In step S223, the CPU 212 determines whether or not the take-up amount L of the third roll R3 is greater than the above described L1 and less than or equal to the above described L2. If L1<L≤L2, the condition of step S223 is satisfied (S223: YES), and the flow proceeds to step S225. If L2<L, the condition of step S223 is not satisfied (S223: NO) and the flow proceeds to step S224.

In step S225, the CPU 212 regards the voltage command value Vref of the motor driving circuit 220 as V2. This command value is a value corresponding to the above described driving torque T2 of the separation sheet take-up motor M3 (refer to the above described FIG. 11). Subsequently, the flow proceeds to step S230.

In step S224, the CPU 212 regards the voltage command value Vref of the motor driving circuit 220 as V3. This command value is a value corresponding to the above described driving torque T3 of the separation sheet take-up motor M3 (refer to the above described FIG. 11).

In step S230, the CPU 212 determines whether or not the above described tape feeding has arrived where the printing head 11 faces the corresponding print end position, by a known technique based on the print data acquired in the above described step S204. If the feeding has not arrived at the print end position, the condition is not satisfied (S230: NO), the flow returns to the above described step S220, and the same procedure is repeated. If the feeding has arrived at the print end position, the condition is satisfied (S230: YES), and the flow proceeds to step S240.

In step S240, the CPU 212 outputs a control signal to the printing head control circuit 221, and stops conducting current to the heating elements of the printing head 11 and print formation (formation of the print part 155) on the above described print-receiving tape 150. At this time, the tape feeding is continually performed. With this arrangement, the tape 150' with print thereafter becomes blank where the print part 155 does not exist (the aforementioned tape 150-0). Subsequently, the flow proceeds to step S250.

In step S250, the CPU 212 determines whether or not the above described tape feeding has arrived at the cutting position by the above described cutter mechanism 30 (a cutting position such as where the total length along the transport direction of the tape 150" with print wound as the second roll R2 by the take-up mechanism 40 becomes the length intended by the user in step S203), in accordance with the total length data acquired in the above described step S203, by a known technique. If the feeding has not arrived at the cutting position, the condition is not satisfied (S250: NO), and the flow loops back and enters a standby state. If the feeding has arrived at the cutting position, the condition is satisfied (S250: YES), and the flow proceeds to step S260.

In step S260, the CPU 212 outputs a control signal to the motor driving circuits 218, 219, 220, and stops the driving of the feeding motor M1, the adhesive take-up motor M2, and the separation sheet take-up motor M3. With this arrangement, the feeding of the above described print-receiving tape 150, the tape 150' with print, and the tape 150" with print (including the above described tape 150-0 as well) is stopped.

Subsequently, in step S265, the CPU 212 outputs a control signal to the motor driving circuit 222, drives the above described cutter motor MC, and cuts the tape 150" with print by the operation of the above described cutter mechanism 30 (refer to the above described FIG. 12A).

Then, the flow proceeds to step S270, and the CPU 212 outputs a control signal to the motor driving circuit 219, starts the driving of the adhesive take-up motor M2 and the take-up of the end edge of the tape 150" with print (refer to the above described FIG. 12B).

Subsequently, in step S275, the CPU 212 determines whether or not a predetermined amount of time has passed since the cutting action of the cutter mechanism 30 in the above described step S265. If the predetermined amount of time has not passed, the condition is not satisfied (S275: NO), and the flow loops back and enters a standby state. This predetermined amount of time only needs to be a sufficient amount of time for taking up the above described end edge of the tape 150" with print on the above described winding core 41 of the take-up mechanism 40. If the above described predetermined amount of time has passed, this condition is satisfied (S275: YES), and the flow proceeds to step S280.

In step S280, the CPU 212 outputs a control signal to the motor driving circuit 219 and stops the driving of the adhesive take-up motor M2. With this arrangement, the end edge of the tape 150" with print generated by the above described cutting can be reliably taken up.

Once the above described step S280 ends, this flow is terminated.

As described above, in this embodiment, a voltage command value Vref from the CPU 212 to the motor driving circuit 220 corresponding to the increase in the roll outer diameter of the third roll R3 resulting from the separation material layer 151 around the above described winding core 29 is switched in a plurality of stages (the three stages V1→V2→V3 in the above described example), thereby making it possible to control the separation sheet take-up motor M3 so as to generate a driving torque of a size appropriate for the take-up of the separation material layer 151 having the above described outer diameter. As a result, it is possible to suppress the wastefulness of generating a large torque that is actually not required and execute efficient torque control, as described above. Note that, even in a case where the same control as described above is applied to the control of the adhesive take-up motor M2 as described above, the same advantages can be achieved. Further, the above described control may also be applied to both the separation sheet take-up motor M3 and the adhesive take-up motor M2.

Further, in particular, according to this embodiment, as described above, it is possible to suppress the size of the above described slippage amount released by the slip clutch 182 within a predetermined scope by generating a driving torque of a size appropriate for the roll outer diameter of the third roll R3 during take-up of the separation material layer 151. As a result, it is possible to avoid the aforementioned harmful effect (in which the slippage amount significantly increases) and improve the durability of the slip clutch 182. Note that, even in a case where the same control as described above is applied to the control of the adhesive take-up motor M2, it is possible to achieve the same advantages as described above with respect to the slip clutch 182 related to the second roll R2.

Further, in particular, according to this embodiment, the voltage command value Vref output to the motor driving circuit 220 is switched in stages, thereby controlling the separation sheet take-up motor M3 so as to generate a driving torque of a size that corresponds to the increase in the outer diameter of the third roll R3 and is appropriate for the take-up of the third roll R3 having that outer diameter, as described above. Then, as described above, it is possible to apply the same control as described above to the control of the adhesive take-up motor M2 as well. As a result, dual-axis control between the take-up of the separation material layer 151 by the above described winding core 29 and the take-up of the tape 150" with print by the above described winding core 41 can be performed, making it possible to form the above described second roll R2 without winding irregularity by appropriate torque control.

Further, in this embodiment, the number of rotations of the winding core 41 is detected based on the detection result by the optical sensor 223, and the CPU 212 determines whether or not the first roll R1 has reached the tape end based on the value of the detected number of rotations (refer to the above described step S221). With this arrangement, it is possible to reliably detect that the first roll R1 has reached the tape end based on the print-receiving tape 150 passing between the printing head 11 and the feeding roller 12 and the number of rotations of the winding core 41 sharply increasing as described above.

Further, in particular, according to this embodiment, the print-receiving tape 150 of the first roll R1 is wound around the winding core 39 so that the tip end on the transport direction upstream side is removable from the winding core 39. With this arrangement, the tape end that comes off the winding core 39 and becomes a free end can be reliably detected based on a sharp increase in the number of rotations of the winding core 41 by the passing of the rear end of the print-receiving tape 150 that has come off the winding core 39 between the printing head 11 and the feeding roller 12.

Further, in particular, according to this embodiment, during normal feeding, it is possible to ensure that an excessive driving torque is not applied to the winding core 41 by the torque limiter function of the slip clutch 182 (the slip clutch 182 disposed on the adhesive take-up motor M2 side; refer to the above described FIG. 6) that releases the driving torque greater than or equal to a predetermined value as a slippage amount. Additionally, when the rear end of the print-receiving tape 150 comes off the winding core 39 as described above, the above described slippage amount becomes "0," making it is possible to reliably increase the number of rotations of the winding core 41. As a result, it is possible to detect the tape end more reliably.

Further, in particular, according to this embodiment, constant torque control that constantly maintains the driving torque of the above described adhesive take-up motor M2 as described above is performed. If such constant torque control is performed, when the rear end of the print-receiving tape 150 comes off the winding core 39 as described above, the number of rotations of the winding core 41 sharply further increases to increase the torque. With this arrangement, it is possible to detect the tape end more reliably.

Note that, in the above, the arrows shown in FIG. 8 denote an example of signal flow, but the signal flow direction is not limited thereto.

Also note that the present disclosure is not limited to the procedures shown in the above described flows of the flowcharts in FIG. 14, and procedure additions and deletions as well as sequence changes and the like may be made without deviating from the spirit and scope of the disclosure.

Further, other than that already stated above, techniques based on the above described embodiments and each of the modifications may be suitably utilized in combination as well.

What is claimed is:

1. A printer comprising:

a feeder configured to feed a long recording medium;

a printing head configured to perform printing on said recording medium fed by said feeder;

a take-up driving device configured to drive a take-up portion for sequentially taking up at least a part of layers of said recording medium fed by said feeder on an outer circumference part and forming a roll;

a take-up amount detecting portion configured to detect a take-up amount by said take-up portion;

a constant torque control device configured to perform constant torque control that sets a driving torque of said take-up driving device to a constant value corresponding to an input command value; and a switching control portion configured to switch said command value output to said constant torque control device in stages in accordance with an increase in said take-up amount detected by said take-up amount detecting portion associated with an advancement of said take-up by said take-up portion, wherein said recording medium is a print-receiving tape comprising a base layer, an adhesive layer provided on one side of said base layer in a thickness direction, and a separation material layer provided on the one side of said adhesive layer in the thickness direction;

wherein said take-up portion comprises:

a first take-up portion configured to take up said separation material layer peeled from said print-receiving tape fed by said feeder on said outer circumference part; and a second take-up portion configured to take up said print-receiving tape that has been fed by said feeder, has been printed on by said printing head, and from which said separation material layer has been peeled, on said outer circumference part;

wherein said take-up driving device comprises:

a first take-up driving device configured to drive said first take-up portion; and a second take-up driving device configured to drive said second take-up portion;

wherein said constant torque control device comprises:

a first constant torque control device configured to perform constant torque control that sets a driving torque of said first take-up driving device to said constant value; and a second constant torque control device configured to perform constant torque control that sets a driving torque of said second take-up driving device to said constant value; and wherein said switching control portion switches said command value output to said first constant torque control device in stages so that said driving torque of said first take-up driving device changes from an initial torque value that is larger than a required take-up torque immediately after starting take-up of said separation material layer by said first take-up portion and smaller than a required take-up torque at a maximum outer diameter of said roll when take-up ends, to a final torque value that is larger than the required take-up torque at said maximum outer diameter, via at least one intermediate torque value that sequentially increases in stages from said initial torque value, and switches said command value output to said second constant torque control device in stages so that said driving torque of said second take-up driving device changes from an initial torque value that is larger than a required take-up torque immediately after starting take-up of said print-receiving tape by said second take-up portion and smaller than a required take-up torque at a maximum outer diameter of said roll when take-up ends, to a final torque value that is larger than the required take-up torque at said maximum outer diameter, via at least one intermediate torque value that sequentially increases in stages from said initial torque value; and wherein the printer further comprises:

a first slip clutch configured to transmit a driving torque generated by said first take-up driving device to said first take-up portion; and a second slip clutch configured to transmit a driving torque generated by said second take-up driving device to said second take-up portion.

2. The printer according to claim 1, wherein:

said first slip clutch is a coil spring wound around a rotating shaft of said first take-up portion.

3. The printer according to claim 1, wherein:

said second slip clutch is a coil spring wound around a rotating shaft of said second take-up portion.

4. The printer according to claim 1, wherein:

said take-up amount detecting portion detects the take-up amount by said take-up portion based on a number of pulses included in a control pulse signal output to a pulse motor configured to drive said feeder.

* * * * *